US010533371B2

(12) United States Patent
Chen et al.

(10) Patent No.: US 10,533,371 B2
(45) Date of Patent: Jan. 14, 2020

(54) SYSTEM AND DEVICE FOR WINDOW COVERING

(71) Applicant: Nien Made Enterprise Co., Ltd., Taichung (TW)

(72) Inventors: Lin Chen, Taichung (TW); Keng-Hao Nien, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 280 days.

(21) Appl. No.: 15/472,297

(22) Filed: Mar. 29, 2017

(65) Prior Publication Data

US 2017/0292321 A1 Oct. 12, 2017

Related U.S. Application Data

(60) Provisional application No. 62/318,771, filed on Apr. 6, 2016.

(51) Int. Cl.

| | |
|---|---|
| ***E06B 9/322*** | (2006.01) |
| ***E06B 9/303*** | (2006.01) |
| ***B65H 75/44*** | (2006.01) |
| ***B65H 75/48*** | (2006.01) |
| ***E06B 9/307*** | (2006.01) |

(Continued)

(52) U.S. Cl.

CPC ..... *E06B 9/322* (2013.01); *B65H 75/4434* (2013.01); *B65H 75/4471* (2013.01); *B65H 75/4492* (2013.01); *B65H 75/486* (2013.01); *E06B 9/303* (2013.01); *E06B 9/307* (2013.01); *E06B 9/388* (2013.01); *E06B 2009/807* (2013.01)

(58) Field of Classification Search

CPC .. E06B 2009/3222; E06B 9/322; E06B 9/307; E06B 9/304

See application file for complete search history.

(56) References Cited

U.S. PATENT DOCUMENTS

| | | | |
|---|---|---|---|
| 4,681,279 | A | 7/1987 | Nakamura |
| 5,123,472 | A | 6/1992 | Nagashima et al. |

(Continued)

FOREIGN PATENT DOCUMENTS

| | | | |
|---|---|---|---|
| AU | 782302 | B2 | 7/2005 |
| AU | 2012370499 | A1 | 9/2014 |

(Continued)

*Primary Examiner* — Katherine W Mitchell
*Assistant Examiner* — Johnnie A. Shablack
(74) *Attorney, Agent, or Firm* — Muncy, Geissler, Olds & Lowe, P.C.

(57) ABSTRACT

A window covering system comprises a shell, a weight member, a covering material positioned between the shell and the weight member, a control device. The covering material comprises at least one ladder, multiple slats corresponding to the at least one ladder, and at least one lifting cord, wherein the lifting cord is connected between the shell and the weight member. The control device comprises a driving module, a releasing module, and an operation module that are connected to each other. The ladder is connected to the operation module, and the lifting cord is connected to the driving module, such that the operation module drives the ladder to tilt the slats, at the same time, the releasing module is driven by the operation module to remove restriction to the driving module, hence descending the weight member.

17 Claims, 22 Drawing Sheets

(51) Int. Cl.
*E06B 9/80* (2006.01)
*E06B 9/388* (2006.01)

(56) References Cited

U.S. PATENT DOCUMENTS

| | | | | |
|---|---|---|---|---|
| 6,129,131 | A | 10/2000 | Colson | |
| 6,155,328 | A | 12/2000 | Welfonder | |
| 6,332,491 | B1 | 12/2001 | Rossini | |
| 6,644,375 | B2 * | 11/2003 | Palmer | E06B 9/322 160/170 |
| 6,715,528 | B2 | 4/2004 | Rossini | |
| 6,823,925 | B2 * | 11/2004 | Militello | E06B 9/262 160/170 |
| 6,948,544 | B2 | 9/2005 | Nien | |
| 6,955,207 | B2 | 10/2005 | Minder | |
| 7,198,089 | B2 | 4/2007 | Hsu | |
| 7,228,797 | B1 * | 6/2007 | Hillman | E06B 9/322 100/170 |
| 7,341,091 | B2 | 3/2008 | Nien | |
| 7,406,995 | B2 | 8/2008 | Huang | |
| 7,578,334 | B2 | 8/2009 | Smith et al. | |
| 7,717,154 | B2 | 5/2010 | Cheng | |
| 8,230,896 | B2 | 7/2012 | Anderson et al. | |
| 8,267,145 | B2 | 9/2012 | Fraser | |
| 8,893,763 | B2 * | 11/2014 | Huang | E06B 9/80 160/170 |
| 9,062,492 | B2 | 6/2015 | Yu | |
| 9,127,500 | B2 | 9/2015 | Huang | |
| 9,260,912 | B2 * | 2/2016 | Huang | E06B 9/322 |
| 9,284,774 | B2 | 3/2016 | Yu et al. | |
| 9,366,077 | B2 * | 6/2016 | Chen | F16H 31/001 |
| 9,435,153 | B2 * | 9/2016 | Chen | E06B 9/322 |
| 9,435,154 | B2 * | 9/2016 | Chen | E06B 9/34 |
| 9,797,189 | B2 * | 10/2017 | Huang | E06B 9/322 |
| 10,138,674 | B2 * | 11/2018 | Hsu | E06B 9/32 |
| 10,273,749 | B2 * | 4/2019 | Lei | B65H 75/26 |
| 10,302,172 | B2 * | 5/2019 | Chen | E06B 9/322 |
| 2002/0088562 | A1 * | 7/2002 | Palmer | E06B 9/322 160/170 |
| 2004/0108080 | A1 | 6/2004 | Nien | |
| 2006/0000561 | A1 * | 1/2006 | Anderson | E06B 9/262 160/168.1 R |
| 2006/0278348 | A1 * | 12/2006 | Huang | E06B 9/322 160/170 |
| 2008/0314530 | A1 * | 12/2008 | Cheng | E06B 9/322 160/170 |
| 2009/0078380 | A1 | 3/2009 | Cheng | |
| 2009/0120592 | A1 | 5/2009 | Lesperance | |
| 2010/0206492 | A1 * | 8/2010 | Shevick | E06B 9/30 160/170 |
| 2010/0258253 | A1 | 10/2010 | Cheng | |
| 2011/0290429 | A1 | 12/2011 | Cheng | |
| 2013/0032300 | A1 * | 2/2013 | Yu | E06B 9/322 160/84.02 |
| 2013/0037225 | A1 | 2/2013 | Huang | |
| 2013/0087415 | A1 | 4/2013 | Hsieh | |
| 2014/0083631 | A1 * | 3/2014 | Huang | E06B 9/322 160/170 |
| 2014/0131502 | A1 | 5/2014 | Zhu | |
| 2014/0291431 | A1 * | 10/2014 | Huang | E06B 9/322 242/372 |
| 2015/0059992 | A1 | 3/2015 | Liu | |
| 2015/0129142 | A1 * | 5/2015 | Huang | E06B 9/262 160/370 |
| 2015/0136336 | A1 * | 5/2015 | Huang | E06B 9/322 160/170 |
| 2015/0211296 | A1 | 7/2015 | Zhang et al. | |
| 2015/0354275 | A1 | 12/2015 | Huang et al. | |
| 2015/0368968 | A1 | 12/2015 | Smith | |
| 2016/0032645 | A1 | 2/2016 | Wen et al. | |
| 2016/0123447 | A1 * | 5/2016 | Chen | F16H 31/001 160/168.1 P |
| 2017/0145743 | A1 * | 5/2017 | Lei | B65H 75/26 |
| 2017/0211318 | A1 * | 7/2017 | Chen | E06B 9/322 |
| 2017/0211319 | A1 * | 7/2017 | Wei | E06B 9/322 |
| 2017/0211321 | A1 * | 7/2017 | Chen | E06B 9/262 |
| 2017/0226799 | A1 * | 8/2017 | Hebeisen | E06B 9/80 |
| 2017/0292322 | A1 * | 10/2017 | Chen | B65H 75/4434 |
| 2017/0298688 | A1 * | 10/2017 | Chen | E06B 9/262 |
| 2019/0063147 | A1 * | 2/2019 | Cheng | E06B 9/322 |

FOREIGN PATENT DOCUMENTS

| | | | |
|---|---|---|---|
| CA | 2805798 | A1 | 8/2014 |
| CN | 101021139 | B | 7/2010 |
| CN | 204402320 | U | 6/2015 |
| CN | 204552565 | U | 8/2015 |
| DE | 202007002787 | U1 | 7/2008 |
| DE | 202015102349 | U1 | 6/2015 |
| JP | H04250287 | A | 9/1992 |
| JP | 1993018168 | A | 1/1993 |
| JP | 2000145328 | A | 5/2000 |
| JP | 2000220369 | A | 8/2000 |
| JP | 3261106 | B2 | 2/2002 |
| JP | 3378813 | B2 | 2/2003 |
| JP | 3442670 | B2 | 9/2003 |
| JP | 3485164 | B2 | 1/2004 |
| JP | 2008013950 | A | 1/2008 |
| JP | 4074420 | B2 | 4/2008 |
| JP | 2013072183 | A | 4/2013 |
| JP | 2013072224 | A | 4/2013 |
| JP | 2015161147 | A | 9/2015 |
| JP | 2015180810 | A | 10/2015 |
| TW | I246415 | B | 1/2006 |
| TW | M305849 | U | 2/2007 |
| TW | I463961 | B | 12/2014 |
| WO | 2010125951 | A1 | 11/2010 |
| WO | 2016009881 | A1 | 1/2016 |

* cited by examiner

SYSTEM AND DEVICE FOR WINDOW COVERING

CROSS REFERENCE TO RELATED APPLICATION

This application claims priority to U.S. Provisional Patent Application No. 62/318,771, filed Apr. 6, 2016, the contents of which are incorporated by reference herein.

FIELD OF THE DISCLOSURE

The present disclosure relates generally to a window covering system. More specifically, the present disclosure relates to a window covering system comprising a control device to adjust slat angle of a covering material and to unlock the window covering system in order to control the level of light blockage of the covering material and to expand the covering material respectively.

BACKGROUND OF THE DISCLOSURE

Traditionally, a cordless window covering system includes a headrail, a covering material, a bottom rail and a driving device, wherein the driving device is usually a spring box. The covering material is positioned between the headrail and the bottom rail, and the covering material can be collected or expanded below the headrail when the bottom rail ascends or descends respectively. When the weight force of the covering material and the bottom rail is balanced by friction force of the whole window covering system, the bottom rail can stop at a position to retain the level of light blockage of the covering material. However, the friction force of the whole window covering system is difficult to be controlled effectively comparing to the weight force of the covering material and the bottom rail. In addition, the closer the bottom rail ascends to the headrail, the more covering material accumulates on the bottom rail, and hence the heavier the overall weight of the bottom rail and the covering material. Therefore, it is likely that the bottom rail would more or less descend for a distance, which is undesired, from a desired retaining position. In such case, it is inconvenient and annoying to anyone operating the window covering system.

BRIEF SUMMARY OF THE DISCLOSURE

In view of the foregoing subject, a general objective of the present disclosure is to provide a window covering system which comprises a control device such that the expansion and the level of light blockage of the covering material can be controlled by a releasing module of the control device and an operation module of the control device effectively.

A window covering system comprises a shell positioned horizontally, a weight member positioned below the shell, a covering material positioned between the shell and the weight member, wherein the covering material comprises at least one ladder, wherein the ladder comprises two warps, and one end of each warp is extended to the shell, and the other end of each warp is connected to the weight member, and a plurality of slats, each of which is spaced and parallel to the other between the two warps, and at least one lifting cord, wherein one end of the lifting cord is extended to the shell, and the other end of the lifting cord is connected to the weight member with the plurality of the slats between the shell and the weight member; a control device comprises a driving module positioned within the shell, wherein the position module comprises a winding assembly, the end of the lifting cord extended to the shell is connected and wound upon the winding assembly, such that the winding assembly is configured to wind or release the lifting cord for moving the weight member toward or away from the shell, and wherein the weight member is configured to drive the winding assembly operating in a first direction via the lifting cord when the weight member moves away from the shell; a releasing module positioned within the shell and configured to operate with the winding assembly simultaneously, wherein the releasing module comprises a pushing unit, a passive unit, and a correlating unit, and wherein the passive unit is positioned corresponding to the pushing unit, and the correlating unit is connected to the driving module such that the correlating unit is configured to operate with the winding assembly simultaneously, and wherein the passive unit is configured to detachably engage the correlating unit such that the winding assembly is restricted from operating in the first direction when the passive unit is engaged to the correlating unit; and an operation module positioned within the shell and configured to operate with the releasing module simultaneously, wherein the operation module comprises a rod and a tilting assembly, and wherein the end of at least one of the two warps extended to the shell is connected to the tilting assembly, such that the tilting assembly is configured to dislocate the two warps for changing an angle of the slats, and wherein the rod is connected between the tilting assembly and the pushing unit of the releasing module, such that when the slats are rotated to a predetermined angle by the tilting assembly, the rod is configured to rotate the pushing unit pushing the passive unit to disengage the passive unit from the correlating unit, thereby the winding assembly is driven by the weight member via the lifting cord to operate in the first direction, such that the correlating unit and the winding assembly operate simultaneously.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, wherein.

In accordance with common practice, the various described features are not drawn to scale and are drawn to emphasize features relevant to the present disclosure. Like reference characters denote like elements throughout the figures and text.

DETAILED DESCRIPTION OF THE DISCLOSURE

Figure 1:
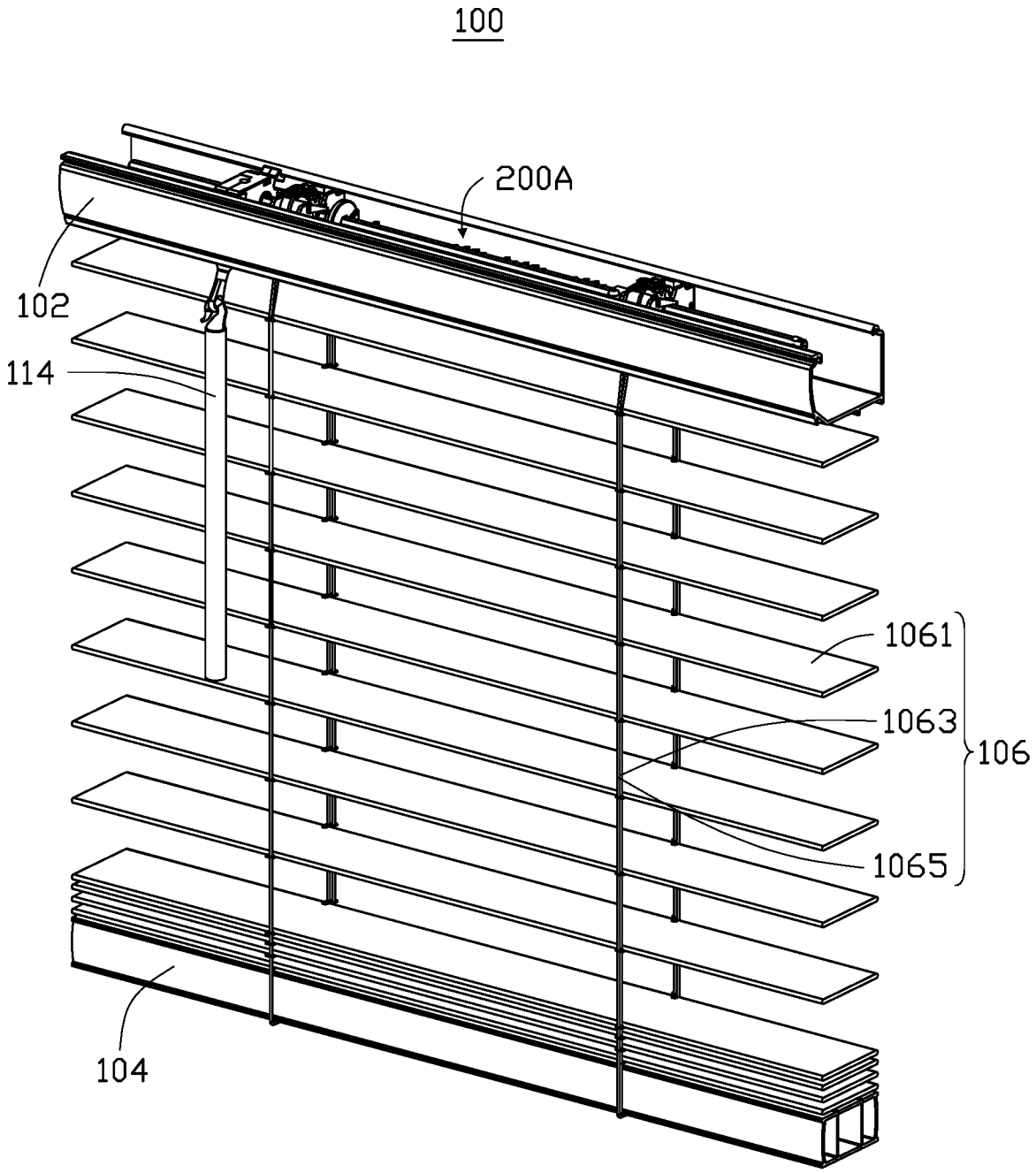
FIG. 1 is a perspective view of a window covering system according to one embodiment of the present disclosure.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

It will be understood that the term "and/or" includes any and all combinations of one or more of the associated listed items. It will also be understood that, although the terms first, second, third etc. may be used herein to describe various elements, components, regions, parts and/or sections, these elements, components, regions, parts and/or sections should not be limited by these terms. These terms are only used to distinguish one element, component, region, part or section from another element, component, region, layer or section. Thus, a first element, component, region, part or section discussed below could be termed a second element, component, region, layer or section without departing from the teachings of the present disclosure.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The description will be made as to the embodiments of the present disclosure in conjunction with the accompanying drawings in FIGS. 1 to 37. Reference will be made to the drawing figures to describe the present disclosure in detail, wherein depicted elements are not necessarily shown to scale and wherein like or similar elements are designated by same or similar reference numeral through the several views and same or similar terminology.

FIG. 1 is a perspective view of a window covering system 100 according to one embodiment of the present disclosure. The window covering system 100 comprises a shell 102, a weight member 104, a covering material 106, and a control device 200A. The covering material 106 is positioned between the shell 102 and the weight member 104, and at least one lifting cord 1063 and at least one ladder 1065 go through the covering material 106. One end of the lifting cord 1063 is connected to the control device 200A, and the other end of the lifting cord 1063 is connected to the weight member 104, so the control device 200A can control the covering material 106 to expand or collect via the lifting cord 1063 such that the weight member 104 moves away from or toward the shell 102 respectively. The window covering system 100 can be in different forms for different usage or design such as a blind, a cellular shade, a roman shade, or a roller shade, but not limited thereto. In one embodiment of the present disclosure, the window covering system 100 is provided in a form of a blind, wherein the covering material 106 is defined by a plurality of slats 1061, and the plurality of slats 1061 are positioned corresponding to a plurality of slots (not denoted) of the ladder 1065. The shell 102 can be a headrail corresponding to the weight element 104 such that the headrail is positioned above the weight element 104. Alternatively, the shell 102 can also be a frame base that can be used to contain one or more modules for easy installation. In one embodiment of the present disclosure, the weight member 104 can be a bottom rail.

Figure 2:
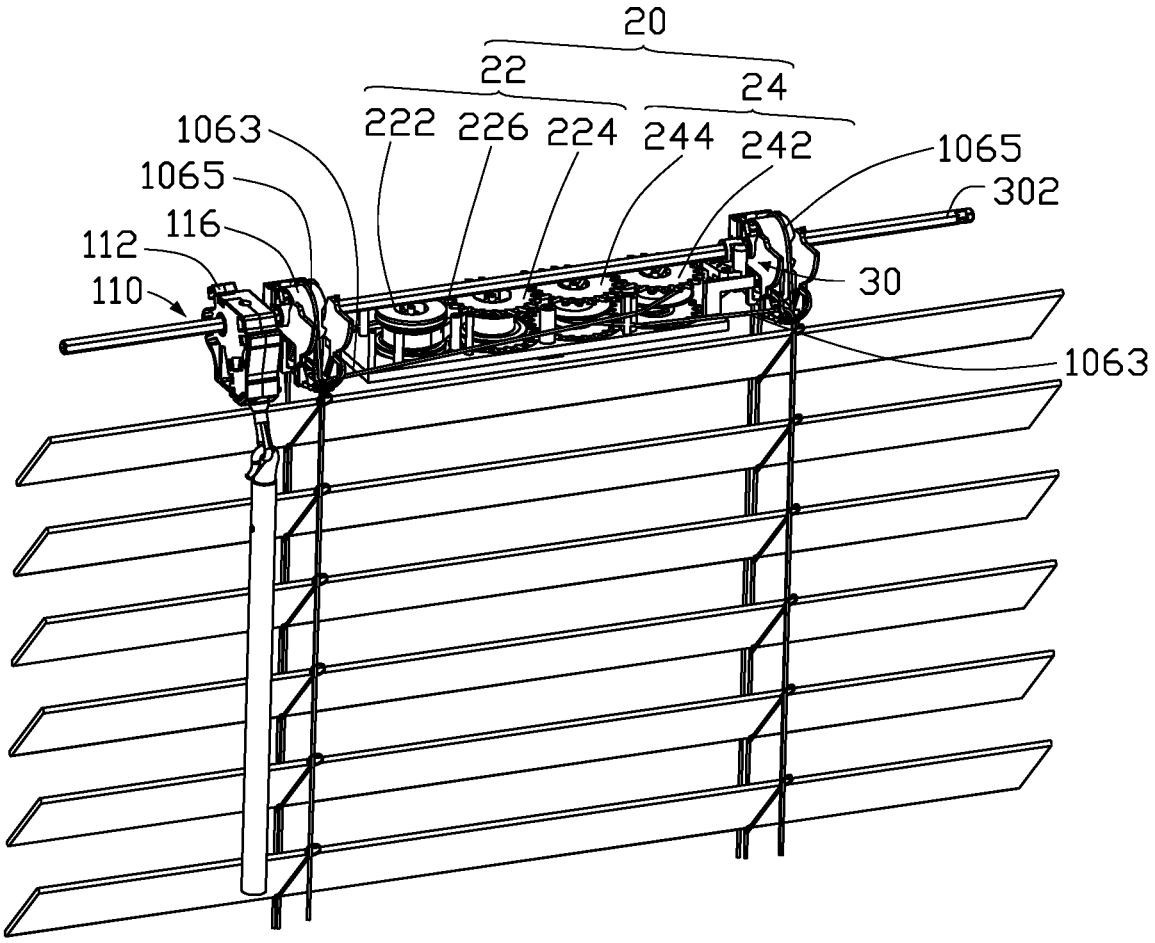
FIG. 2 is a perspective view of a control device of the window covering system in FIG. 1.
Figure 3:
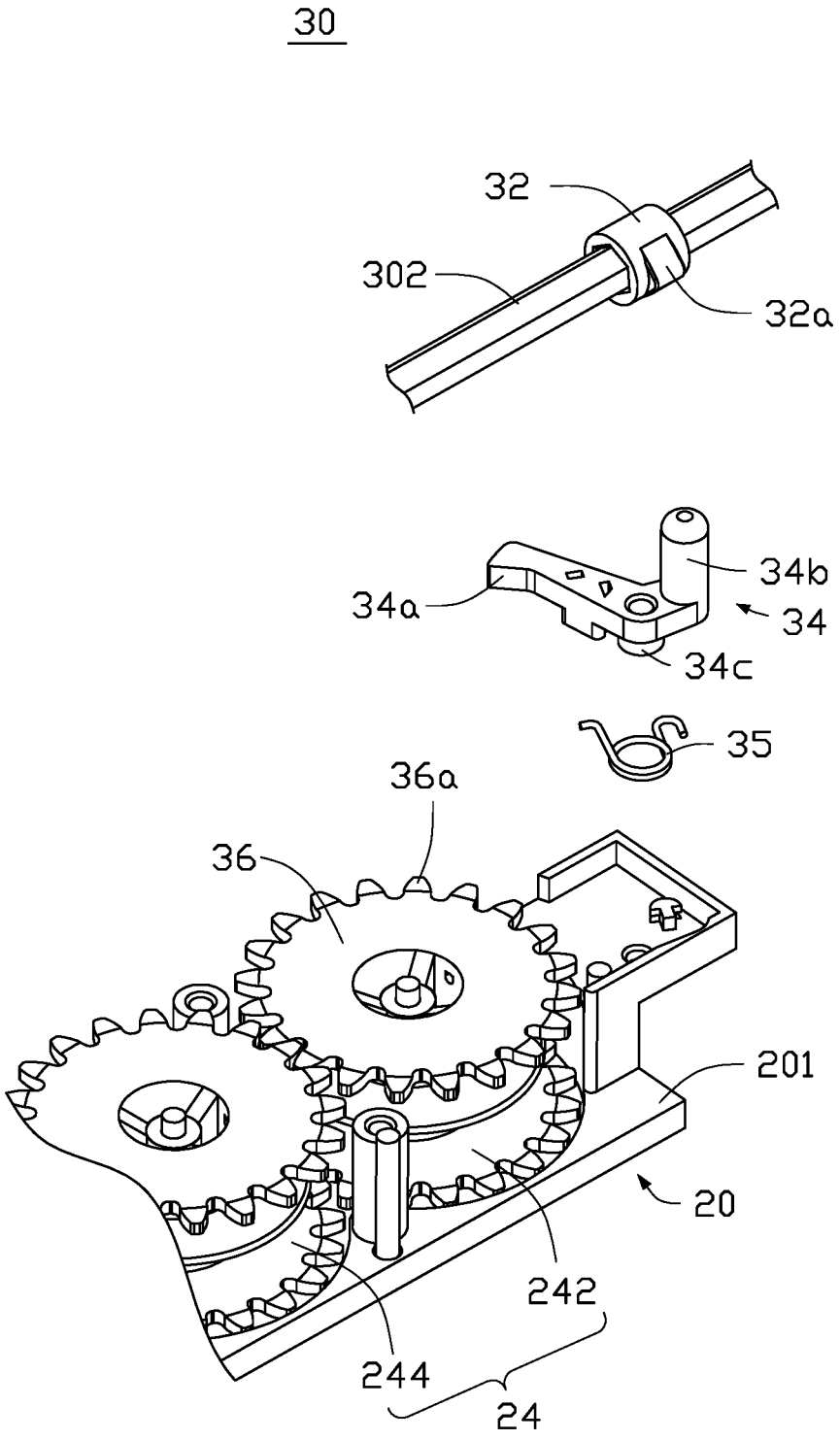
FIG. 3 is an exploded illustration of a releasing module of the control device of the window covering system in FIG. 1 according to one embodiment of the present disclosure.
Figure 4:
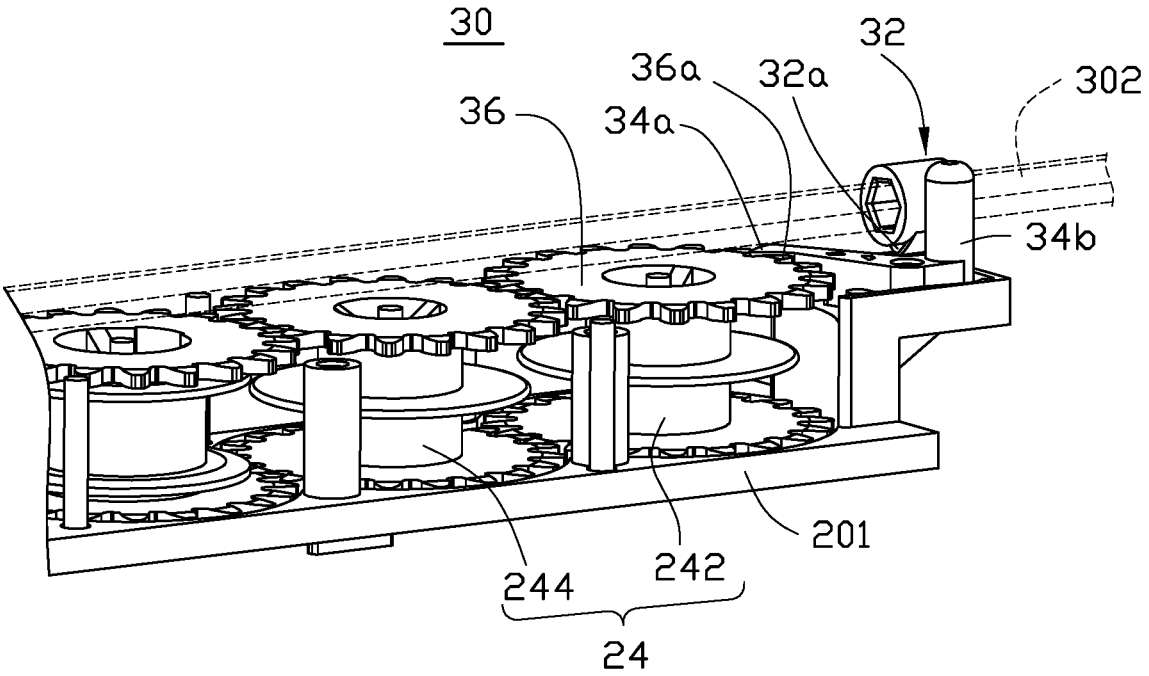
FIG. 4 is a perspective view of the releasing module of the control device of the window covering system in FIG. 3.

Referring to FIG. 1 to FIG. 4, FIG. 2 is a perspective view of the control device 200A of the window covering system 100 in FIG. 1, FIG. 3 is an exploded illustration of a releasing module 30 of the control device 200A of the window covering system 100 in FIG. 1 according to one embodiment of the present disclosure, and FIG. 4 is a partial view of the releasing module 30 in FIG. 3.

As shown in FIG. 2, the control device 200A comprises a driving module 20, the releasing module 30, and an operation module 110. The driving module 20 comprises a power assembly 22 and a winding assembly 24. The power assembly 22 comprises a storing wheel 222, a driving wheel 224, and a resilient member 226, wherein the storing wheel 222 and the driving wheel 224 are positioned within the shell 102, and the storing wheel 222 and the driving wheel 224 can rotate relative to the shell 102. In one embodiment of the present disclosure, the resilient member 226 can be a spiral spring, wherein one end of the spiral spring is connected to the storing wheel 222, and the other end of the spiral spring is connected to the driving wheel 224. For ease of illustration, an initial state of the resilient member 226 is defined by the weight member 104 being at a closest position to the shell 102, such that the covering material 106 is in a complete collected state. As the covering material 106 expands from the complete collected state, the weight member 104 moves from the closest position away from the shell 102. At the same time, the resilient member 226 winds onto the driving wheel 224 from the storing wheel 222 gradually, thereby a recovery force of the resilient member 226 is stored.

Figure 5:
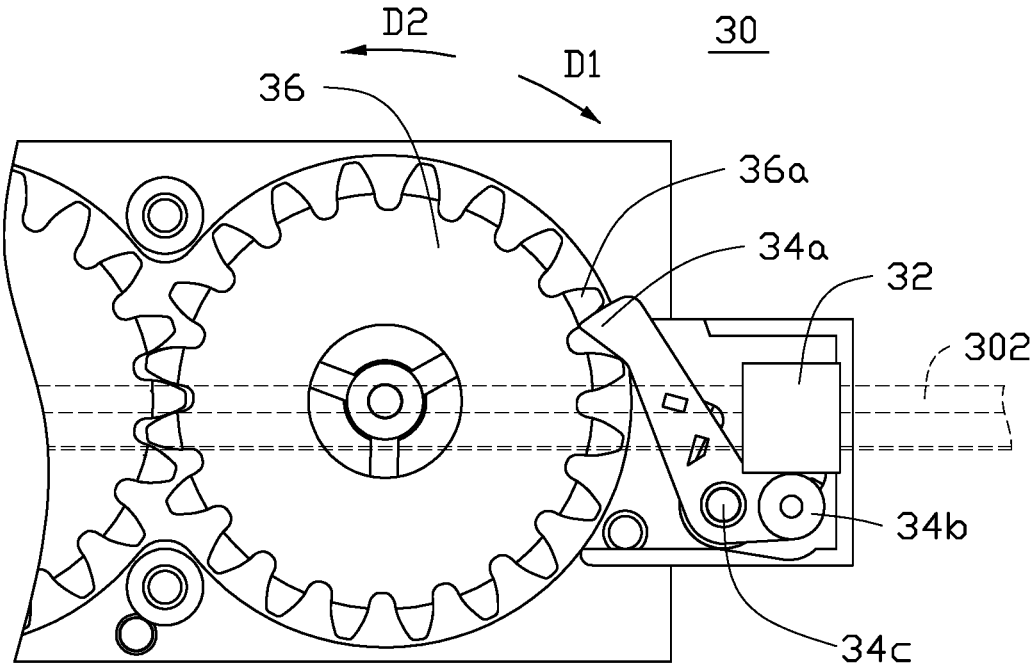
FIG. 5 is a top view of the releasing module of the control device of the window covering system in FIG. 4.

On the other hand, the end of the lifting cord 1063 connected to the winding assembly of the control device 200A is connected to and winds on the winding assembly. Therefore, the winding assembly can operate with the weight member 104 simultaneously via the lifting cord 1063. While the weight member 104 is moving away from the shell 102, the winding assembly is operated to move by the weight member 104 via the lifting cord 1063 toward a first direction D1 (as shown in FIG. 5). In FIG. 2, the winding assembly is a winding spool assembly 24, wherein the winding spool assembly 24 comprises two winding spools 242 and 244, and the winding spool 242 and the winding spool 244 are positioned next to each other within the shell 102, wherein the winding spool 242 and the winding spool 244 can rotate relative to the shell 102. The winding spool 242 and the winding spool 244 are engaged to each other by toothed engagement such that the winding spool 242 and the winding spool 244 can operate simultaneously. In one embodiment of the present disclosure, one end of the lifting cord 1063 is connected to the winding spool 242 or the winding spool 244, and the other end of the lifting cord 1063 is connected to the weight member 104 with the covering material 106 in between. The driving wheel 224 and the winding spool assembly 24 are configured to operate simultaneously through a toothed engagement in between such that the driving wheel 224, the resilient member 226, and the winding spool assembly 24 can operate simultaneously.

In addition, the releasing module 30 is provided within the shell 102 and configured to operate with the winding assembly simultaneously. The releasing module 30 can restrict the winding assembly from operating in the first direction D1 but not a second direction D2 (as shown in FIG. 5), in which the second direction D2 is opposite to the first direction D1. The operation module 110 comprises a rod 302, and the releasing module 30 is connected to the operation module 110 via the rod 302. In one embodiment of the present disclosure, the rod 302 is a light adjusting rod for adjusting the level of light blockage of the covering material 106. The operation module 110 further comprises a tilting assembly 112, an operating member 114, and a tilting wheel 116, wherein the tilting assembly 112 is connected to the rod 302 and the operating member 114, thus the operating member 114 can control the rod 302 to rotate via the tilting assembly 112. In one embodiment of the present disclosure, the operating member 114 can be a stick. One end of the ladder 1065 is connected to the rod 302, and the other end of the ladder 1065 is connected to the weight member 104. The ladder 1065 comprises the plurality of the slots, each of which is corresponding to each of the plurality of slats 1061. When the rod 302 rotates, the ladder 1065 moves the plurality of slats 1061 to tilt for adjusting the level of light blockage of the covering material 106. In one embodiment of the present disclosure, one end of the ladder 1065 is connected to the tilting wheel 116, and the other end is connected to the weight member 104, therefore the level of light blockage of the covering material 106 can be adjusted by operating the operation module 110 which rotates the tilting wheel 116.

The releasing module 30 is provided within the shell 102 and configured to operate with the winding assembly simultaneously. As shown in FIG. 3, the releasing module 30 comprises a pushing unit 32, a passive unit 34, and a correlating unit 36. The passive unit 34 is positioned corresponding to the pushing unit 32, so the passive unit 34 can be operated by the pushing unit 32. The correlating unit 36 is connected to the driving module 20 and configured to operate with the winding assembly simultaneously. The passive unit 34 is detachably engaged to the correlating unit 36, thus the winding assembly is restricted from operating in the first direction D1 when the passive unit 34 is engaged to the correlating unit 36. As shown in FIG. 3, the pushing unit 32 is sleeved to the rod 302 of the operation module 110. An elastic unit 35 is provided on the passive unit 34, wherein the elastic unit 35 always urges the passive unit 34 engaging to the correlating unit 36 when no external force is applied thereto. To be more specific, the elastic unit 35 is positioned between the passive unit 34 and a base 201 of the driving module 20 for providing a biasing force to urge the passive unit 34 toward the correlating unit 36 constantly. In one embodiment of the present disclosure, the pushing unit 32 can be a cam wheel.

In FIG. 3, the pushing unit 32 has a protrusion 32*a*, wherein the protrusion 32*a* protrudes outward from the pushing unit 32 in a radial direction of the rod 302. In other words, the protrusion 32*a* protrudes in a direction away from an axis of the rod 302. The passive unit 34 has a pillar 34*b* which corresponds to the protrusion 32*a*, thus the pillar 34*b* can be pushed by the protrusion 32*a* to move when the protrusion 32*a* is driven by the rod 302, therefore the passive unit 34 is driven away from the correlating unit 36, so the winding assembly can be driven by the weight member 104 to operate in the first direction D1. The passive unit 34 further comprises a stopping part 34*a* and an axis part 34*c*, wherein the passive unit 34 is pivotally connected on the base 201 about the axis part 34*c*. The stopping part 34*a* can move with the pillar 34*b* simultaneously, and the correlating unit 36 has a fitting part 36*a*, wherein the stopping part 34*a* can detachably engage to the fitting part 36*a*. The protrusion 32*a* can push the pillar 34*b* when the rod 302 rotates, therefore the passive unit 34 pivots about the axis part 34*c*. Furthermore, the elastic unit 35 of the passive unit 34 is sleeved to the axis part 34*c*, such that the elastic unit 35 urges the stopping part 34*a* of the passive unit 34 engaging to the fitting part 36*a* of the correlating unit 36 constantly when no external force is applied thereto.

As shown in FIG. 5, the stopping part 34*a* of the passive unit 34 is exemplified by a pawl, wherein the pawl corresponds to the fitting part 36*a* of the correlating unit 36 such that the pawl can engage the fitting part 36*a*, but not limited thereto. As aforementioned, the power assembly 22 and the winding spool assembly 24 are configured to operate simultaneously via toothed engagement, therefore the stopping part 34*a* can correspond to a gear on any one of the wheel (not denoted) among the power assembly 22 and the winding spool assembly 24. Alternatively, the stopping part 34*a* can also correspond to an additional wheel (not shown) which can operate with the power assembly 22 or the winding spool assembly 24 simultaneously, thus achieving the same effect.

The protrusion 32*a* is provided at a surface of the pushing unit 32 such that protruding outward in a radial direction of the pushing unit 32. In other words, the protrusion 32*a* protrudes in a direction away from an axis of the rod 302. The pushing unit 32 can be driven by the rod 302 such that the protrusion 32*a* moves away from the pillar 34*b* of the passive unit 34. When the protrusion 32*a* is not in contact with the pillar 34*b*, the stopping part 34*a* of the passive unit 34 is urged by the biasing force from the elastic unit 35 to engage the fitting part 36*a*. A side of the stopping part 34*a* corresponding to the fitting part 36*a* is an inclined surface, thus the teeth (not denoted) of the fitting part 36*a* can one-way slide over the inclined surface of the stopping part 34*a*, such that the winding spool assembly 24 can operate in the second direction D2, which is opposite to the first direction D1, in order to wind the lifting cord 1063. Therefore, a user can push the weight member 104 upward to collect the covering material 106. While the fitting part 36*a* is sliding over the stopping part 34*a* in the second direction D2, the passive unit 34 can pivot back and forth relative to the fitting part 36*a* due to the biasing force of the elastic unit 35. As shown in FIG. 4, the correlating unit 36 is coaxial with the winding spool 242 of the winding spool assembly 24 and configured to operate with the winding spool 242 simultaneously. More specifically, the correlating unit 36 and the winding spool 242 of the winding spool assembly 24 can be formed in one piece.

The correlating unit 36 and the winding spool 242 cannot rotate in the first direction D1 when the stopping part 34*a* of the passive unit 34 is urged to engage the fitting part 36*a* by the biasing force of the elastic unit 35. However, the correlating unit 36 and the winding spool 242 can rotate in the second direction D2 due to the aforementioned inclined surface. More specifically, the stopping part 34*a* of the passive unit 34 is configured to engage between the teeth of the fitting part 36*a* of the correlating unit 36. In addition, the correlating unit 36 is configured to operate simultaneously and to be coaxial with the winding spool 242 of the winding spool assembly 24. Therefore, the winding spool 242 is restricted from rotating if the winding spool 242 is about to rotate in the first direction D1, thus the winding spool 242 does not release the lifting cord 1063, hence the weight member 104 and the covering material 106 are stationary. Moreover, the winding spool 242 is also configured to operate with the winding spool 244 and the power assembly 22 simultaneously, so the power assembly 22 does not operate when the winding spool 242 is restricted from rotating in the first direction D1.

Figure 6:
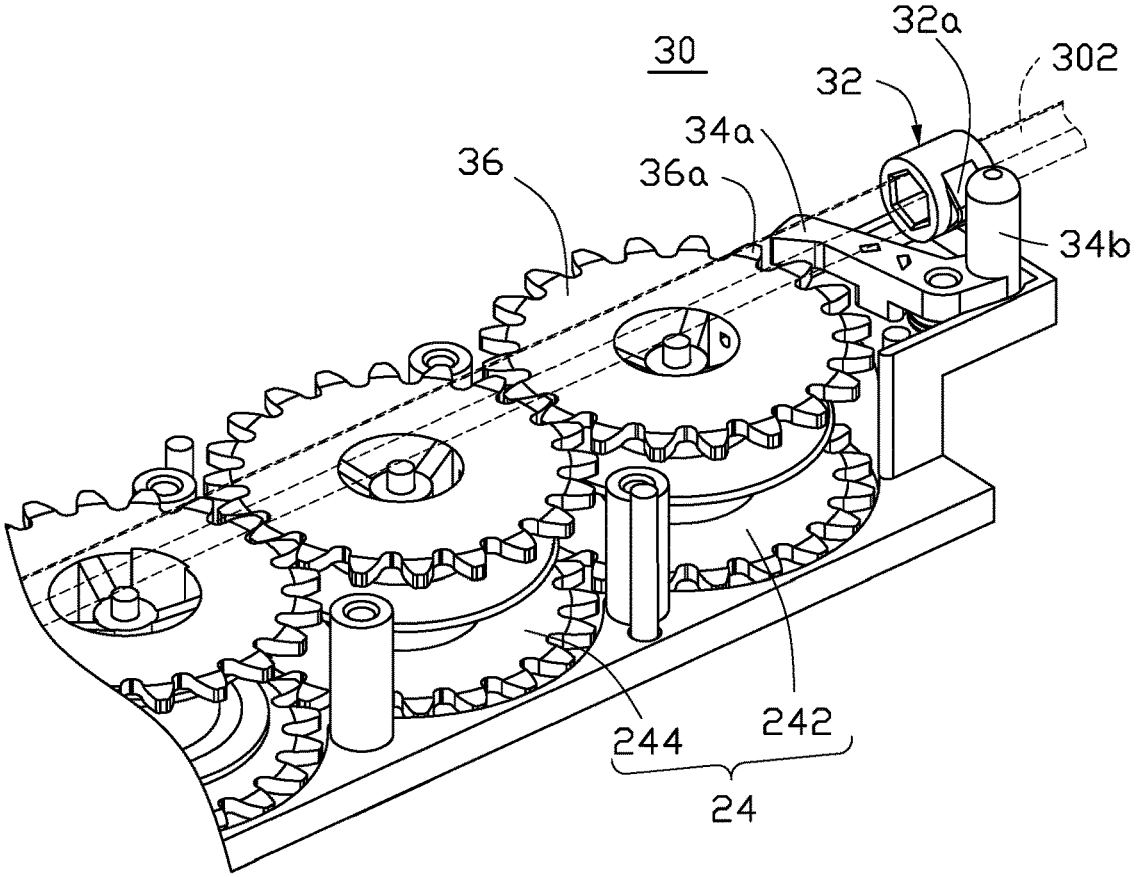
FIG. 6 is a schematic illustration showing operation of the releasing module of the control device of the window covering system in FIG. 4.
Figure 7:
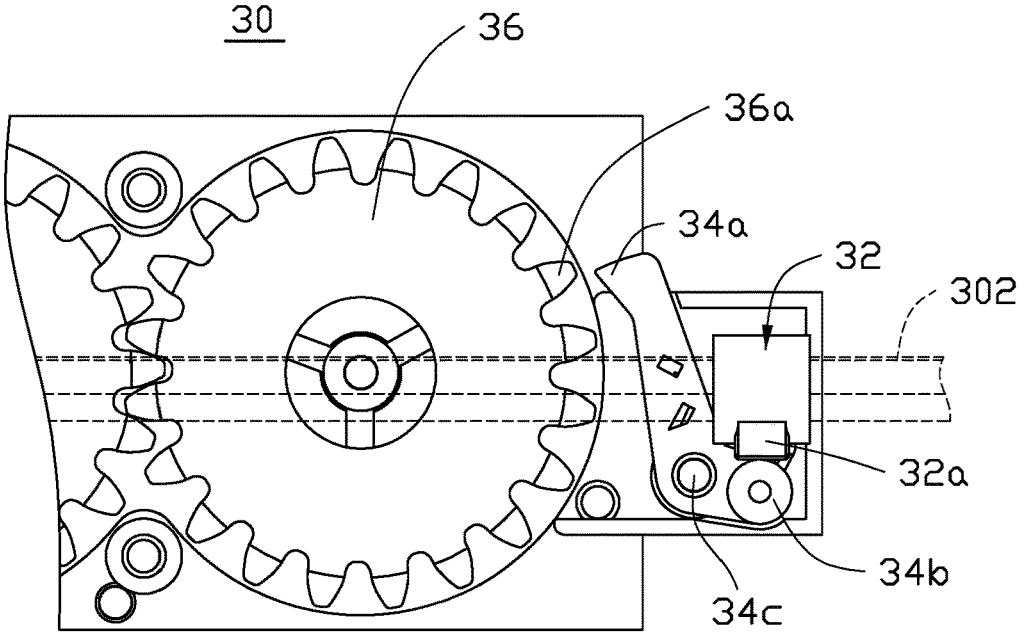
FIG. 7 is a top view of the releasing module of the control device of the window covering system in FIG. 6.

Referring to FIG. 6 and FIG. 7, as the rod 302 drives the protrusion 32*a* of the pushing unit 32 to push the pillar 34*b*, the passive unit 34 pivots such that the stopping part 34*a* of the passive unit 34 is disengaged from the fitting part 36*a* of the correlating unit 36, hence the stopping part 34*a* does not restrict the correlating unit 36. Therefore, the weight member 104 can descend by gravity to expand the covering material 106. Furthermore, descending of the weight member 104 drives the winding spool 242 to rotate via the lifting cord 1063 due to the simultaneous operation and coaxial configuration between the correlating unit 36 and the winding spool 242.

Figure 8:
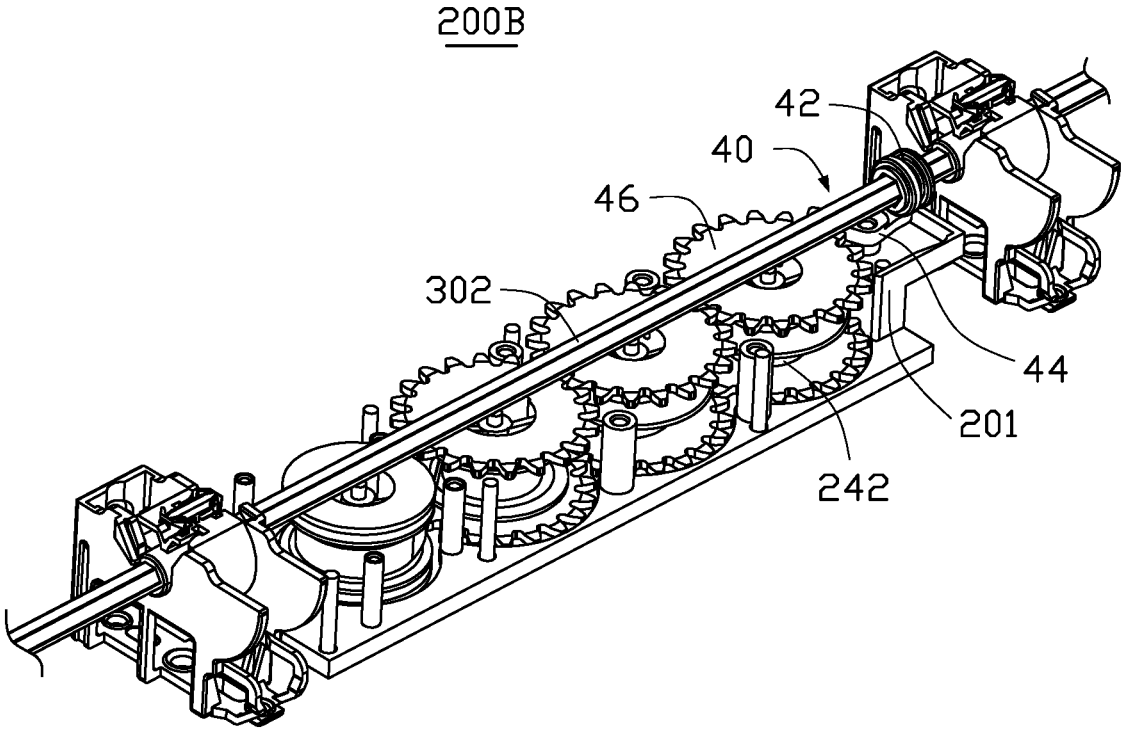
FIG. 8 is a perspective view of a releasing module of the control device of the window covering system in FIG. 1 according to another embodiment of the present disclosure.
Figure 9:
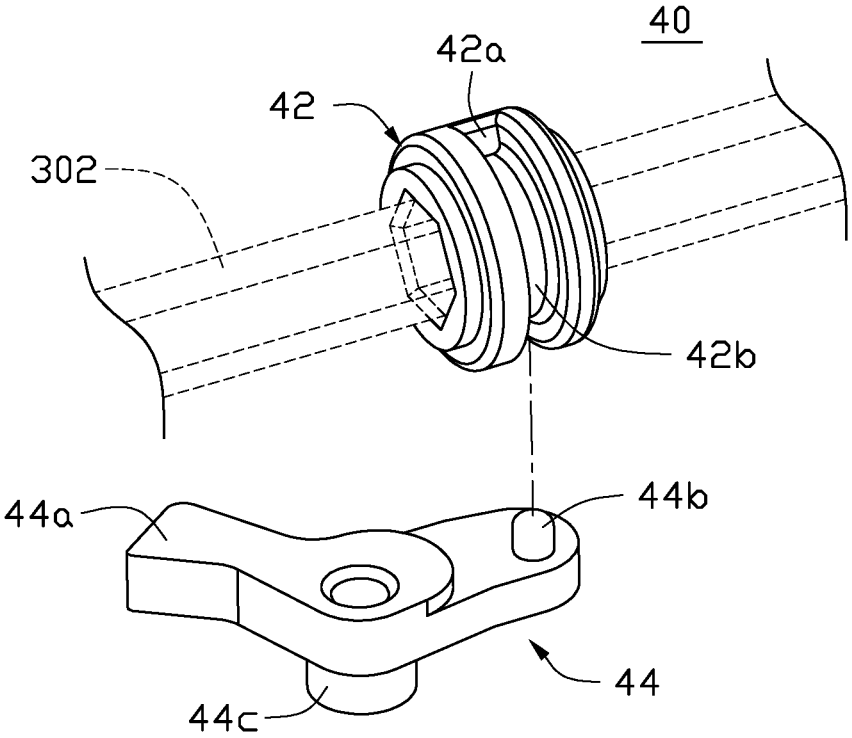
FIG. 9 is an exploded view of the releasing module in FIG. 8.
Figure 10:
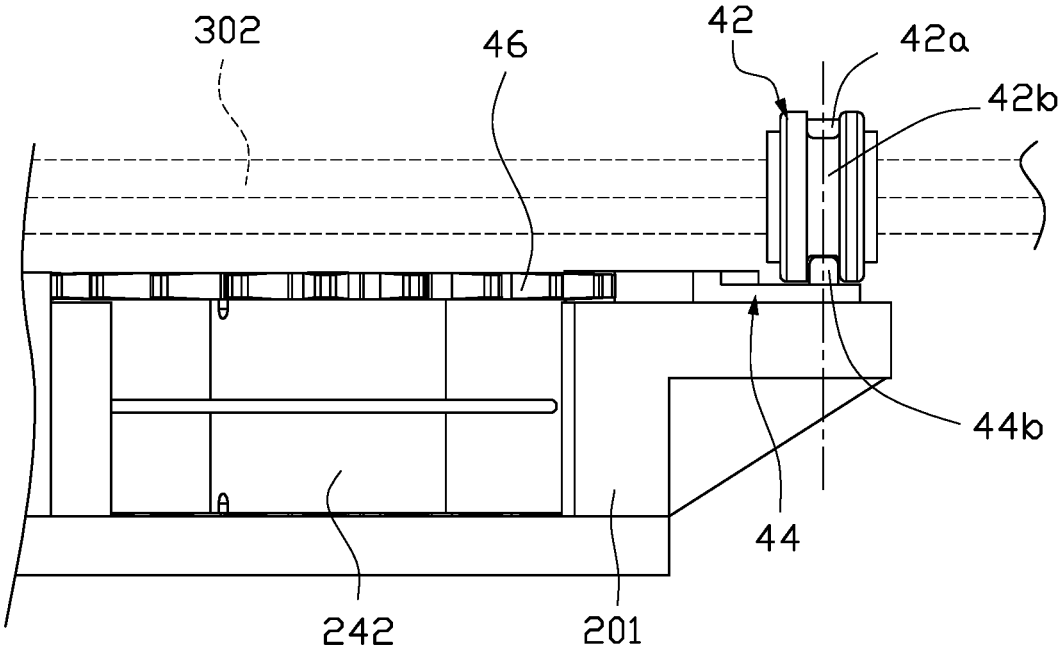
FIG. 10 is a side view of the releasing module in FIG. 8.
Figure 11:
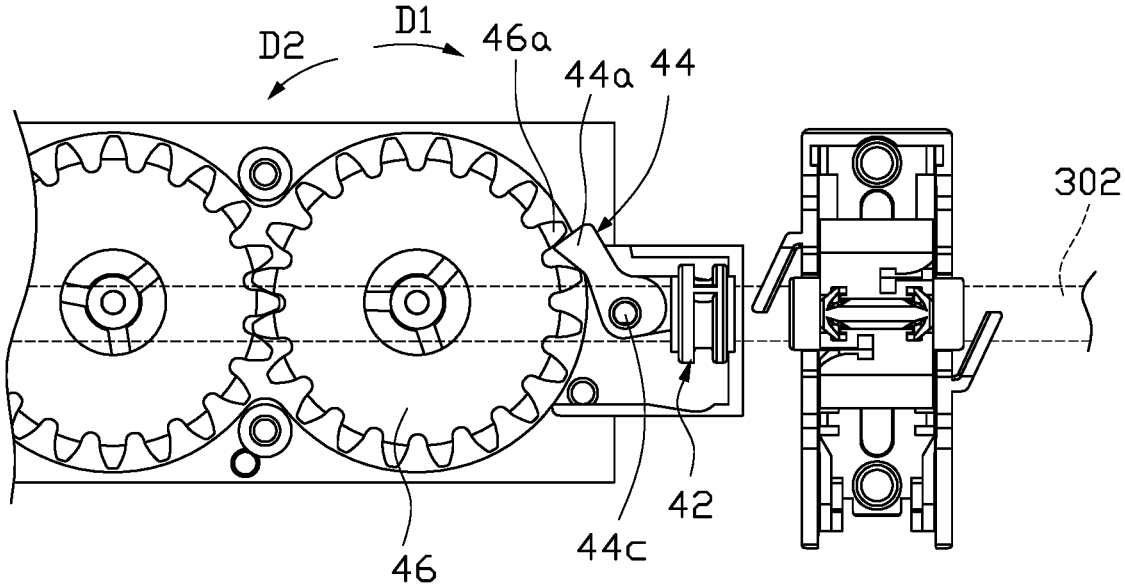
FIG. 11 is a top view of the releasing module in FIG. 8.
Figure 12:
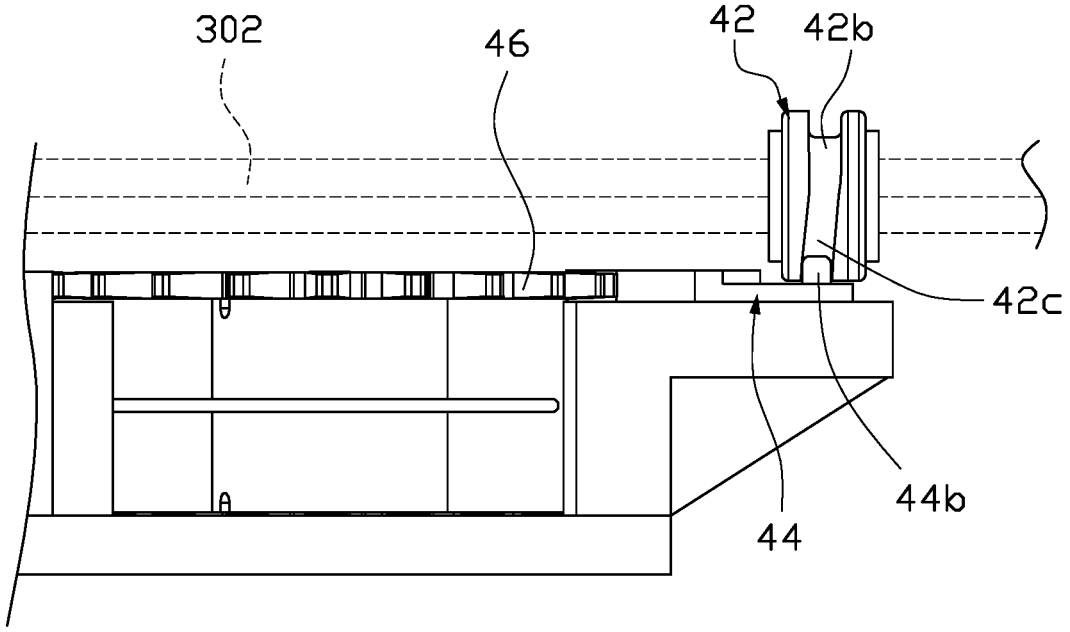
FIG. 12 is an schematic illustration showing operation of the releasing module in FIG. 8.
Figure 13:
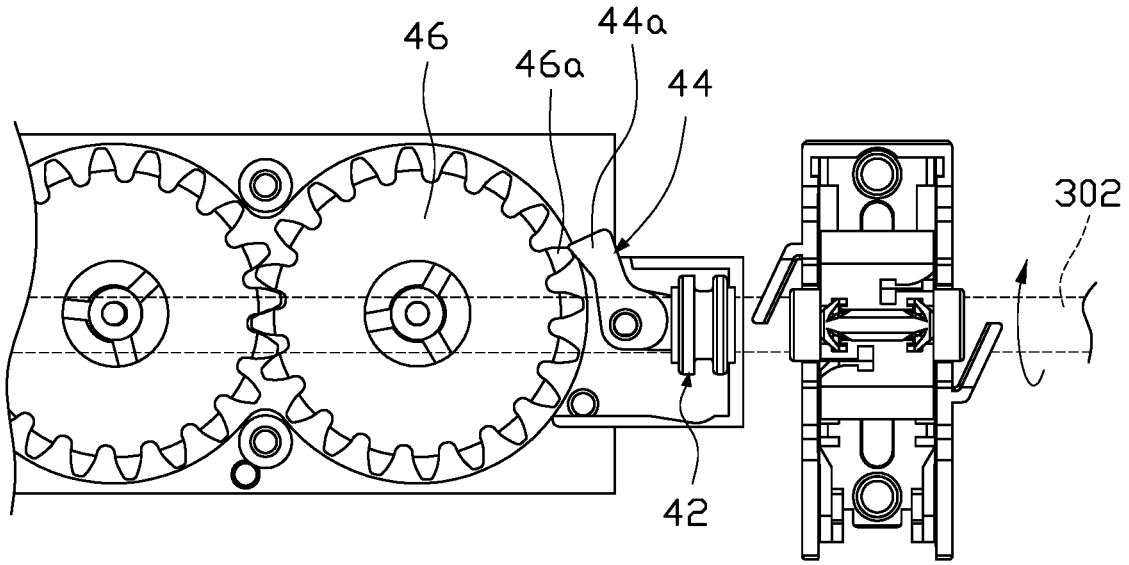
FIG. 13 is a top view of the releasing module in FIG. 12.

Referring to FIG. 8 to FIG. 13, a releasing module 40 of a control device 200B of the window covering system 100 is provided. More specifically, FIG. 8 is a perspective view of the releasing module 40 of the control device 200B according to one embodiment of the present disclosure; FIG. 9 is an exploded view of the releasing module 40 in FIG. 8; FIG. 10 is a side view of the releasing module 40 in FIG. 8; FIG. 11 is a top view of the releasing module 40 in FIG. 8; FIG. 12 is an schematic illustration showing operation of the releasing module 40 in FIG. 8; FIG. 13 is a top view of the releasing module 40 in FIG. 12.

In one embodiment of the present disclosure, the releasing module 40 of the driving device 200B comprises a pushing unit 42, a passive unit 44, and a correlating unit 46. The pushing unit 42 is sleeved to the rod 302 and configured to operate simultaneously with the operation module (not denoted), and the passive unit 44 is pivotally connected within the shell 102 to correspond to the driving module 20 such that the passive unit 44 can detachably engage to the driving module 20. The pushing unit 42 has a protrusion 42*a* corresponding to the passive unit 44 such that the protrusion 42*a* can push the passive unit 44. The passive unit 44 comprises a stopping part 44*a*, a pillar 44*b*, and an axis part 44*c*. As shown in FIG. 11, the stopping part 44*a* can move with the pillar 44*b* simultaneously, and the correlating unit 46 is restricted from rotating in the first direction D1 by the stopping part 44*a* when the passive unit 44 is engaged to the correlating unit 46. As shown in FIG. 13, the stopping part 44*a* does not restrict the correlating unit 46 when the passive unit 44 is driven by the protrusion 42*a* to disengage from the correlating unit 46, such that the correlating unit 46 can rotate in the first direction D1. In one embodiment of the present disclosure, the pushing unit 42 can be a cam wheel.

In one embodiment of the present disclosure, the pushing unit 42 comprises a protrusion 42*a* and a groove 42*b*, wherein the groove 42*b* can be an annular groove, and the protrusion 42*a* is provided within the groove 42*b*. The stopping part 44*a* of the passive unit 44 is exemplified by a claw, and the pillar 44*b* of the passive unit 44 is positioned within the groove 42*b* to be corresponding to the protrusion 42. The passive unit 44 is pivotally connected on the base 201 about the axis part 44*c*, and the stopping part 44*a* corresponds to a fitting part 46*a* of the correlating unit 46, such that the stopping part 44*a* can detachably engage to the fitting part 46*a*. The groove 42*b* is recessed at an outer surface of the pushing unit 42 in a radial direction, so the pillar 44*b* can be fit within the groove 42*b* (as shown in FIG. 10), such that the protrusion 42*a* within the groove 42*b* can push the pillar 44*b* to cause the stopping part 44*a* to engage between the teeth (not denoted) of the fitting part 46*a* (as shown in FIG. 11), hence the correlating unit 46 is restricted from rotating in the first direction D1. In one embodiment of the present invention, the correlating unit 46 is configured to operate simultaneously and to be coaxial with the winding spool 242 of the winding spool assembly 24, therefore the correlating unit is restricted from rotating in the first direction D1 when the stopping part 44*a* is engaged to the fitting part 46*a*. Therefore, the winding spool 242 is restricted from rotating in the first direction D1 as well, hence the lifting cord 1063 is not released by the winding spool 242 such that the weight member 104 and the covering material 106 can be stationary.

As shown in FIG. 12 and FIG. 13, the groove 42*b* has an inclined section 42*c*, wherein the inclined section 42*c* has gradient with respect to the groove 42*b*. The inclined section 42*c* can guide the pillar 44*b* to move, thus the passive unit 44 is pivoted by the pushing unit 42. When the rod 302 is rotated, the protrusion 42*a* of the pushing unit 42 pushes the pillar 44*b* to move to the inclined section 42*c*, thus the passive unit 44 is pivoted to cause the stopping part 44*a* to disengage from the fitting part 46*a*. At this moment, the correlating unit 46 and the winding spool 242 can rotate in the first direction D1 simultaneously due to the simultaneous operate and coaxial configuration thereof.

Figure 14:
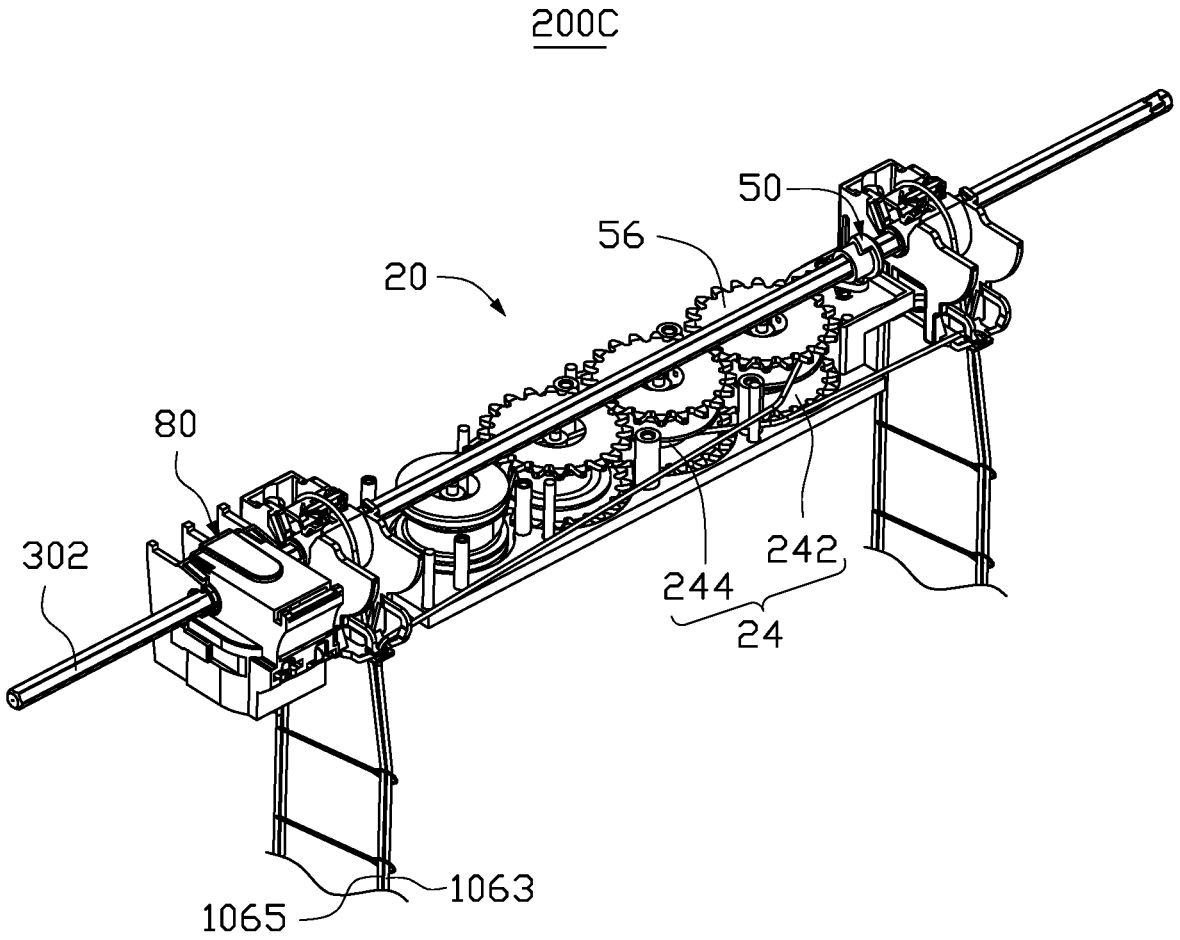
FIG. 14 is a perspective view of a releasing module of the control device of the window covering system in FIG. 1 according to another embodiment of the present disclosure.
Figure 15:
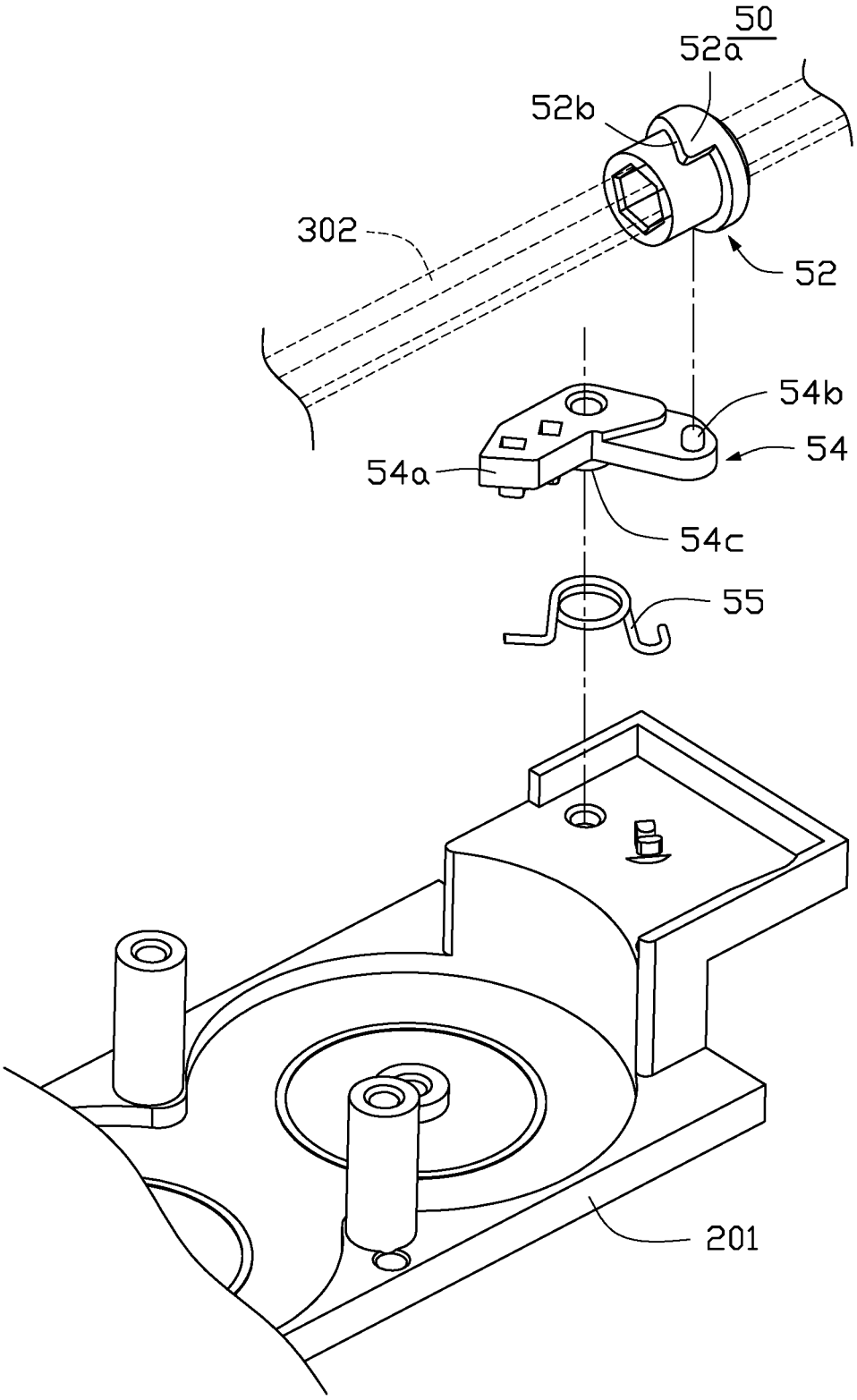
FIG. 15 is an exploded view of the releasing module in FIG. 14.
Figure 16:
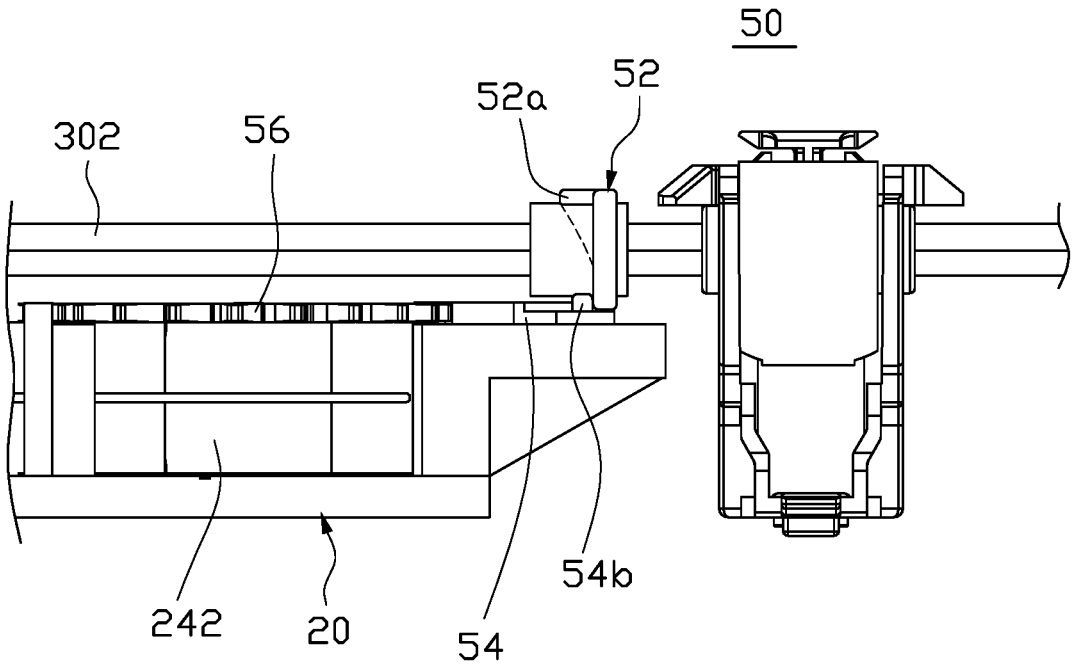
FIG. 16 is an side view of the releasing module in FIG. 14.
Figure 17:
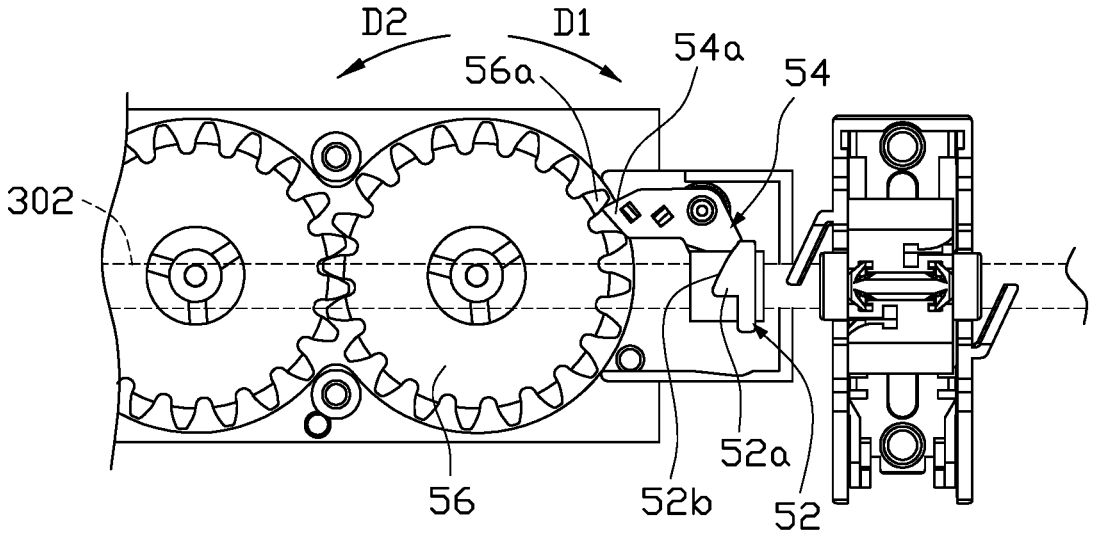
FIG. 17 is an top view of the releasing module in FIG. 14.
Figure 18:
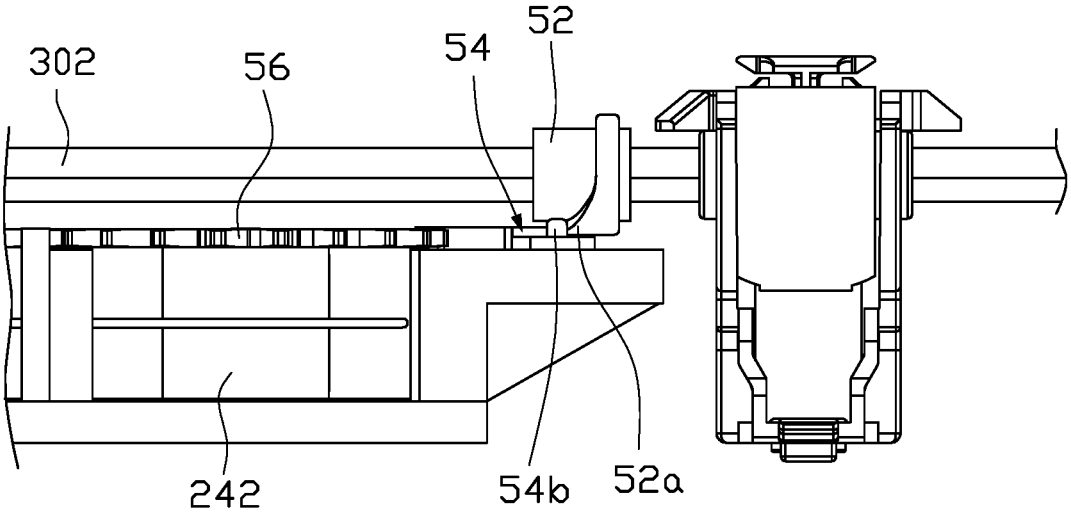
FIG. 18 is an schematic illustration showing operation of the releasing module in FIG. 14.
Figure 19:
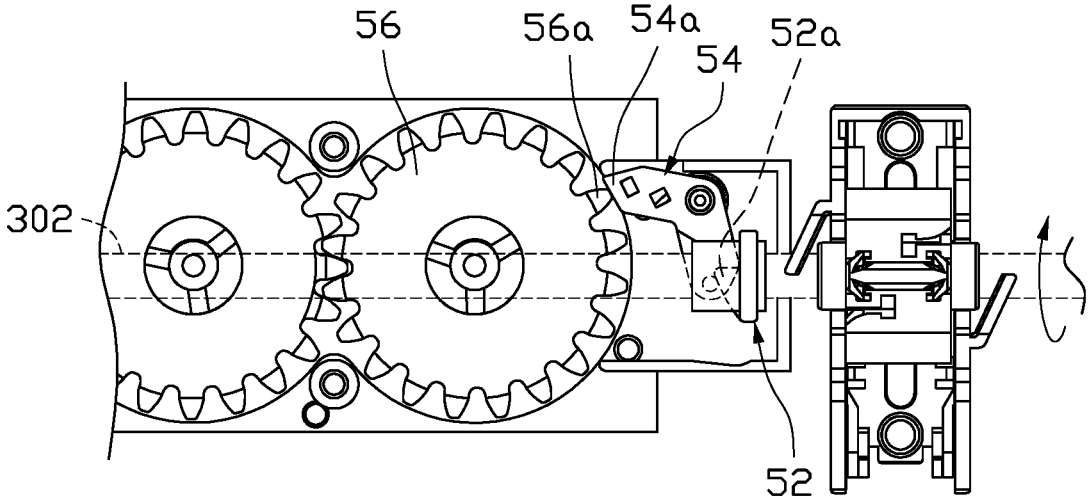
FIG. 19 is an top view of the releasing module in FIG. 18.

Referring to FIG. 14 to FIG. 19, a releasing module 50 of a control device 200C of the window covering system 100 according to one embodiment of the present disclosure is provided. More specifically, FIG. 14 is a perspective view of the releasing module 50 of the control device 200C of the window covering system 100 according to one embodiment of the present disclosure; FIG. 15 is an exploded view of the releasing module 50 in FIG. 14; FIG. 16 is an side view of the releasing module 50 in FIG. 14; FIG. 17 is an top view of the releasing module 50 in FIG. 14; FIG. 18 is an schematic illustration showing operation of the releasing module 50 in FIG. 14; FIG. 19 is an top view of the releasing module 50 in FIG. 18.

In one embodiment of the present disclosure, the releasing module 50 of the driving device 200C comprises a pushing unit 52, a passive unit 54, and a correlating unit 56. The pushing unit 52 is sleeved to the rod 302 and configured to operate simultaneously with the operation module (not denoted). The passive unit 54 is pivotally connected on the base 201 to correspond to the correlating unit 56, wherein the correlating unit 56 is provided in the driving module 20 and configured to operate simultaneously with the driving module 20. The pushing unit 52 has a protrusion 52*a* corresponding to the passive unit 54 such that the protrusion 52*a* can push the passive unit 54. The passive unit 54 comprises a stopping part 54*a*, a pillar 54*b*, and an axis part 54*c*, wherein the stopping part 54*a* can move with the pillar 54*b* simultaneously, and the correlating unit 56 is restricted from rotating in the first direction D1 (as shown in FIG. 17) by the stopping part 54*a* when the passive unit 54 is engaged to the correlating unit 56. On the contrary, the correlating unit 56 can rotate freely in the first direction D1 when the rod 302 rotates to move the pushing unit 52 pushing the passive unit 54, such that the passive unit 54 is disengaged from the correlating unit 56. In one embodiment of the present disclosure, the pushing unit 52 can be a cam wheel.

In one embodiment of the present disclosure, the stopping part 54*a* of the passive unit 54 is exemplified by a claw, wherein the passive unit 54 is pivotally connected on the base 201 about the axis part 54*c*. The stopping part 54*a* is configured to correspond to a fitting part 56*a* of the correlating unit 56, such that the stopping part 54*a* can be detachably engaged to the fitting part 56*a*. The protrusion 52*a* of the pushing unit 52 is configured to correspond to the pillar 54*b* of the passive unit 54, such that the protrusion 52*a* can push the pillar 54*b*. The protrusion 52*a* is provided at an outer surface of the pushing unit 52 such that protruding outward in a radial direction of the rod 302. In other words, the protrusion 52*a* protrudes in a direction away from an axis of the rod 302. As shown in FIG. 15, the protrusion 52*a* has an inclined face 52*b* which is configured to push the pillar 54*b*, thus the pillar 54*b* is pushed to move along an axial direction of the rod 302, hence the passive unit 54 is pivoted.

The passive unit 54 further comprises an elastic unit 55 which is sleeved to the axial part 54*c*. A side of the stopping part 54*a* corresponding to the fitting part 56*a* is an inclined surface. When the stopping part 54*a* of the passive unit 54 is urged by a biasing force from the elastic unit 55 to engage the fitting part 56*a*, the teeth (not denoted) of the fitting part 56*a* can one-way slide over the stopping part 54*a* due to the inclined surface of the stopping part 54*a*, such that the winding spool 242 can rotate in the second direction D2 in order to wind the lifting cord 1063. Therefore, a user can push the weight member 104 upward to collect the covering material 106. While the fitting part 56*a* is sliding over the stopping part 54*a*, the passive unit 54 can pivot back and forth relative to the fitting part 56*a* due to the biasing force of the elastic unit 55.

The correlating unit 56 is configured to operate simultaneously and to be coaxial with the winding spool 242 of the winding spool assembly 24. Therefore, the winding spool 242 and the correlating unit 56 are restricted from rotating if the winding spool 242 is about to rotate in the first direction D1 when the stopping part 54*a* is engaged between the teeth of the fitting part 56*a*. Thus, the winding spool 242 does not release the lifting cord 1063, hence the weight member 104 and the covering material 106 are stationary.

On the other hand, the passive unit 54 is pivoted to cause the stopping part 54*a* disengaging from the fitting part 56*a* (as shown in FIG. 18 and FIG. 19) when the inclined face 52*b* of the protrusion 52*a* of the pushing unit 52 is driven by the rotation of the rod 302 to push the pillar 54*b*. By this moment, the correlating unit 56 and the winding spool 242 can rotate freely, hence the weight member 104 can descend by gravity to expand the covering material 106.

Figure 20:
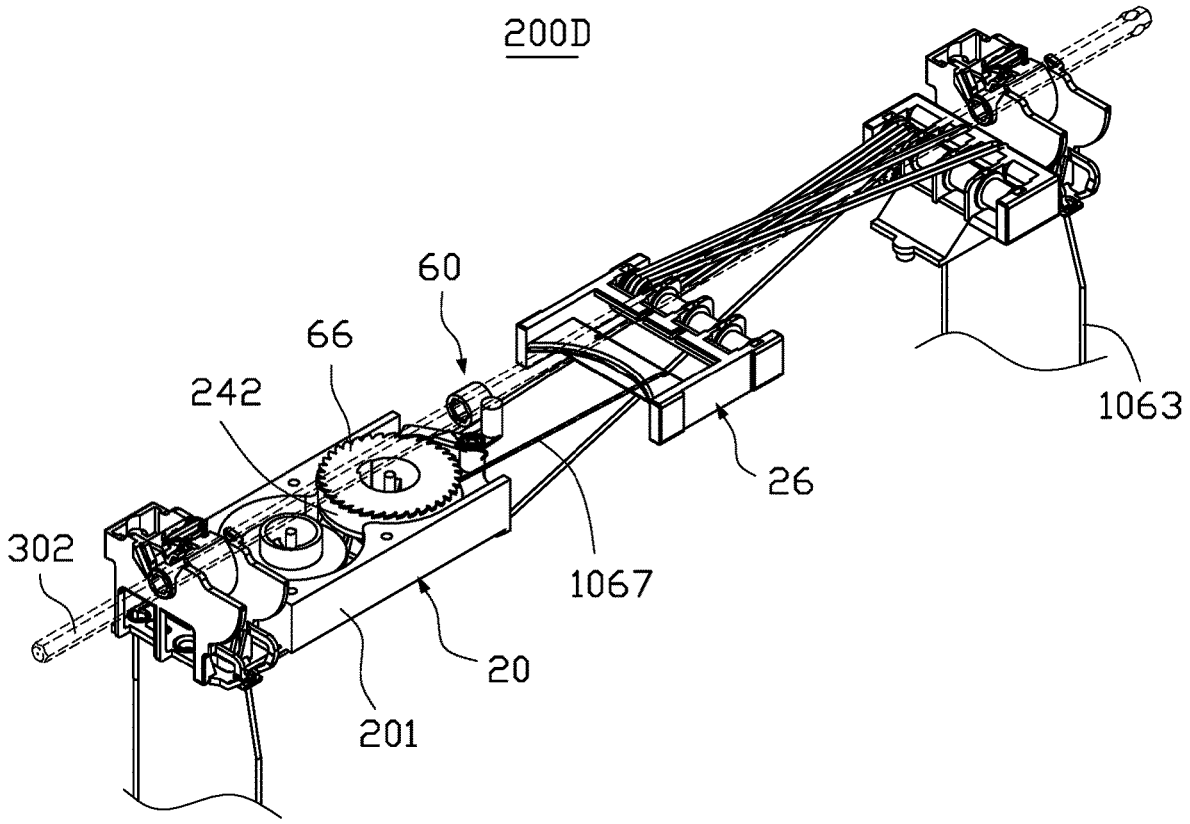
FIG. 20 is a perspective view of a releasing module of the control device of the window covering system in FIG. 1 according to another embodiment of the present disclosure.
Figure 21:
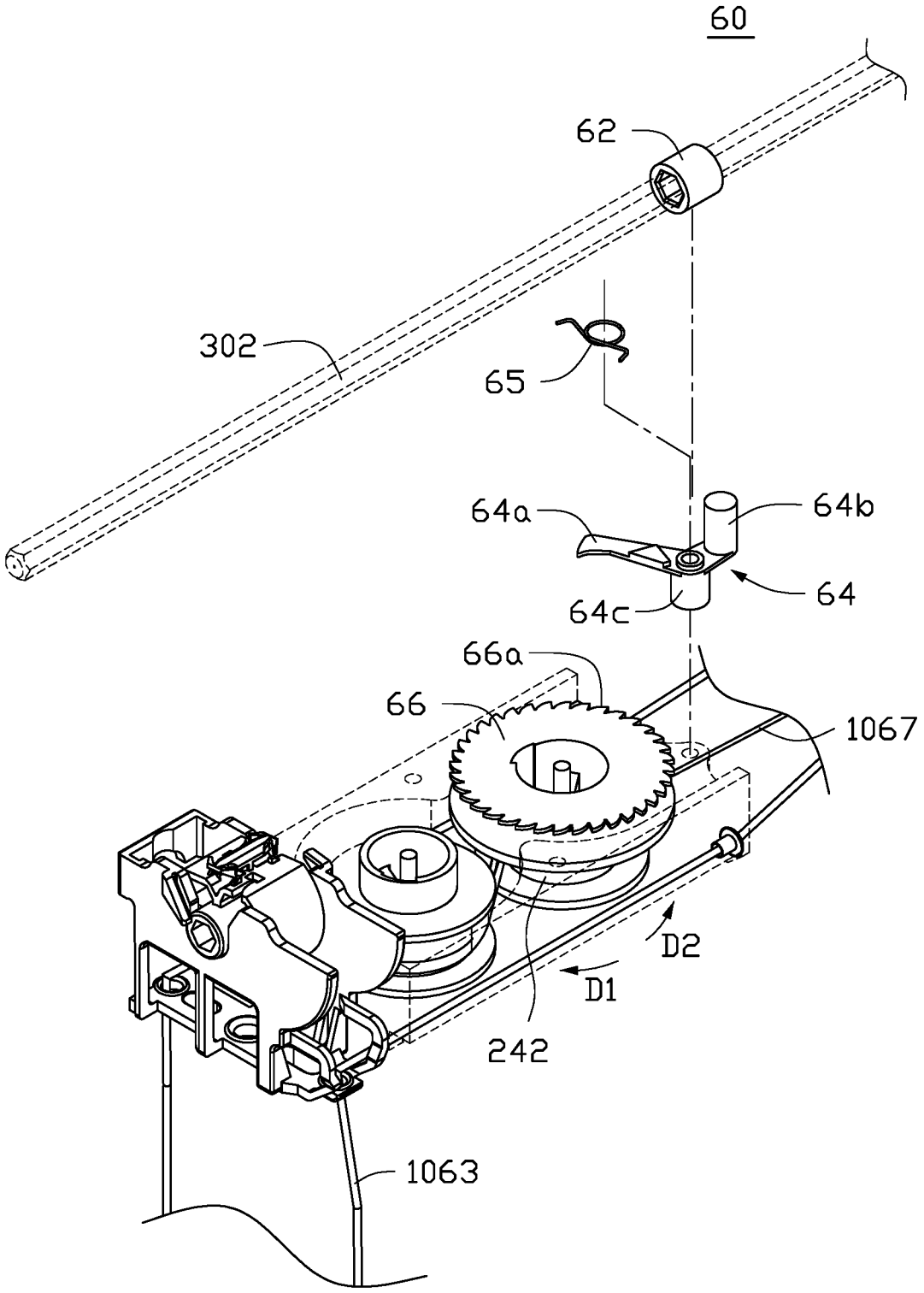
FIG. 21 is an exploded view of the releasing module in FIG. 20.

Referring to FIG. 20 and FIG. 21, a releasing module 60 of a control device 200D of the window covering system 100 is provided. Specifically, FIG. 20 is a perspective view of the releasing module 60 of the control device 200D of the window covering system 100 according to one embodiment of the present disclosure; FIG. 21 is an exploded view of the releasing module 60 in FIG. 20.

In one embodiment of the present disclosure, the winding assembly of the control device 200D can be a sliding assembly (not denoted), wherein the sliding assembly comprises a sliding unit 26 which corresponds to the winding spool 242, and the sliding unit 26 can move back and forth relative to the winding spool 242. An end of the lifting cord 1063 is fixed to the sliding unit 26, and the other end of the lifting cord 1063 passing through the covering material 106 is fixed to the weight member 104, thus the expansion and collection of the covering material 106 can be controlled. A connecting cord 1067 is connected between the sliding unit 26 and the winding spool 242, therefore the winding spool 242 winds or releases the connecting cord 1067 simultaneously as the sliding unit 26 moves in order to control the expansion and collection of the covering material 106.

In one embodiment of the present disclosure, the releasing module 60 comprises a pushing unit 62, a passive unit 64, and a correlating unit 66. The pushing unit 62 is sleeved to the rod 302 and configured to operate simultaneously with the operation module (not denoted). The passive unit 64 is pivotally connected on the base 201 to correspond to the correlating unit 66. The pushing unit 62 has a protrusion (not shown) corresponding to the passive unit 64 such that the protrusion can push the passive unit 64. The passive unit 64 comprises a stopping part 64*a*, a pillar 64*b*, an axis part 64*c*, and an elastic unit 65, wherein the axis part 64*c* of the passive unit 64 is provided between the elastic unit 65 and the base 201, such that the elastic unit 65 can provide a biasing force to urge the passive unit 64 to engage toward the correlating unit 66 constantly. The stopping part 64*a* can move with the pillar 64*b* simultaneously (as shown in FIG. 21). The correlating unit 66 is restricted from rotating in the first direction D1 by the stopping part 64*a* when the stopping part 64*a* is engaged to the correlating unit 66. On the contrary, the correlating unit 66 can rotate freely in the first direction D1 when the protrusion drives the stopping part 64*a* of the passive unit 64 to disengage from the correlating unit 66. In one embodiment of the present disclosure, the pushing unit 62 can be a cam wheel.

In one embodiment of the present disclosure, the stopping part 64*a* of the passive unit 64 is exemplified by a pawl; the correlating unit 66 is exemplified by a ratchet wheel; the fitting part 66*a* of the correlating unit 66 is exemplified by the teeth of the ratchet wheel. The passive part 64 is pivotally connected to the base 201 about the axis part 64*c* of the passive part 64, such that the stopping part 64*a* is corresponding to the fitting part 66*a* of the correlating unit 66, and the protrusion of the pushing unit 62 is corresponding to the pillar 64*b* of the passive unit 64.

The protrusion is provided at an outer surface of the pushing unit 62 such that protruding outward in a radial direction of the pushing unit 62. In other words, the protrusion protrudes in a direction away from an axis of the rod 302. When the stopping part 64*a* of the passive unit 64 is urged by a biasing force from the elastic unit 65 to engage the fitting part 66*a* of the correlating unit 66, the fitting part 64*a* of the correlating unit 66 can one-way slide over the stopping part 64*a* of the passive unit 64, thus the correlating unit 66 can rotate in the second direction D2 which is opposite to the first direction D1. While the fitting part 66*a* is sliding over the stopping part 64*a*, the passive unit 64 can pivot back and forth relative to the correlating unit 66 due to the biasing force of the elastic unit 65. The correlating unit 66 is configured to operate simultaneously and to be coaxial with the winding spool 242. Therefore, the winding spool 242 rotates in the second direction D2 to wind the lifting cord 1063 when the correlating unit 66 rotates in the second direction D2. At this time, a user can push the weight member 104 upward to collect the covering material 106.

Therefore, the winding spool 242 and the correlating unit 66 are restricted from rotating if the winding spool 242 is about to rotate in the first direction D1 when the stopping part 64*a* is engaged between the teeth of the fitting part 66*a*. Thus, the winding spool 242 does not release the lifting cord 1063, hence the weight member 104 and the covering material 106 are stationary.

However, when the stopping part 64*a* is engaged to the fitting part 66*a* of the correlating unit 66, the correlating unit 66 and the winding spool 242 are restricted from rotating in the first direction D1, thus the winding spool 242 cannot release the connecting cord 1067, such that the sliding unit 26 cannot move to release the lifting cord 1063, hence the weight member 104 and the covering material 106 are stationary.

On the contrary, the passive unit 64 is pivoted to cause the stopping part 64*a* disengaging from the fitting part 66*a* when the protrusion of the pushing unit 62 is driven by the rotation of the rod 302 to push the pillar 64*b*. Therefore, the winding spool 242 can rotate freely, hence the weight member 104 can descend by gravity to expand the covering material 106.

Figure 22:
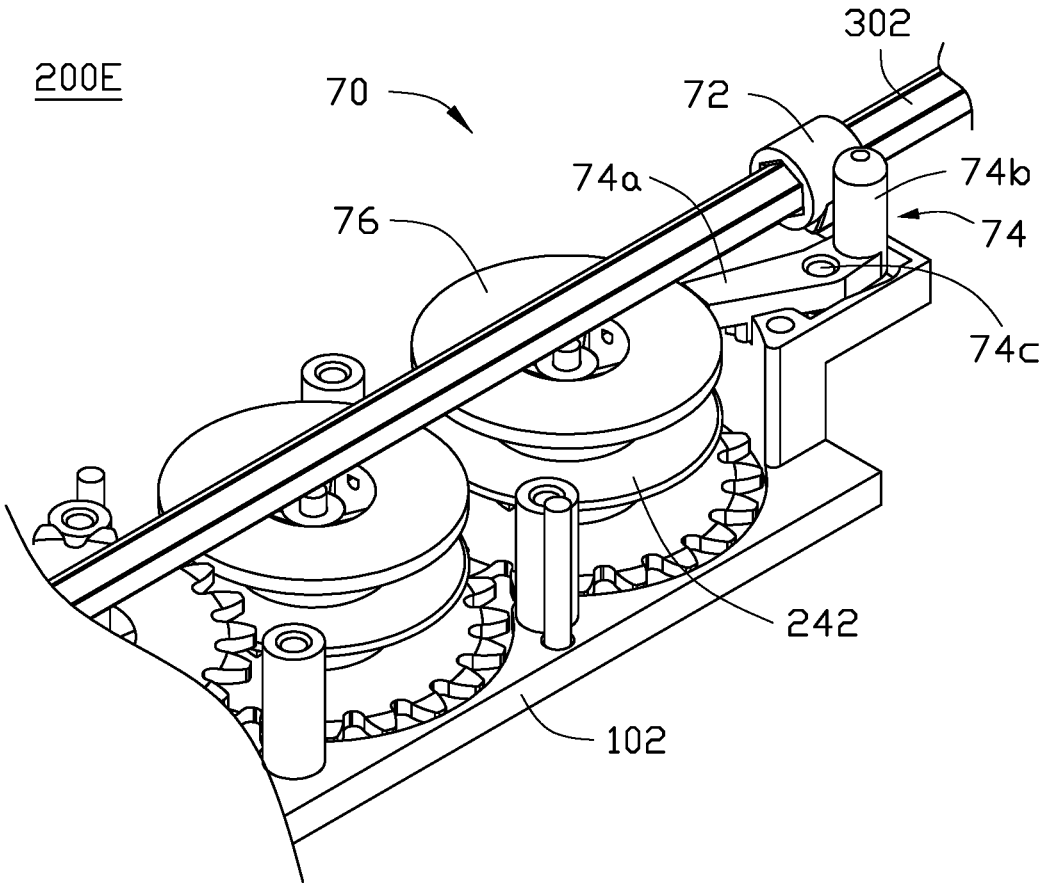
FIG. 22 is a perspective view of a releasing module of the control device of the window covering system in FIG. 1 according to another embodiment of the present disclosure.
Figure 23:
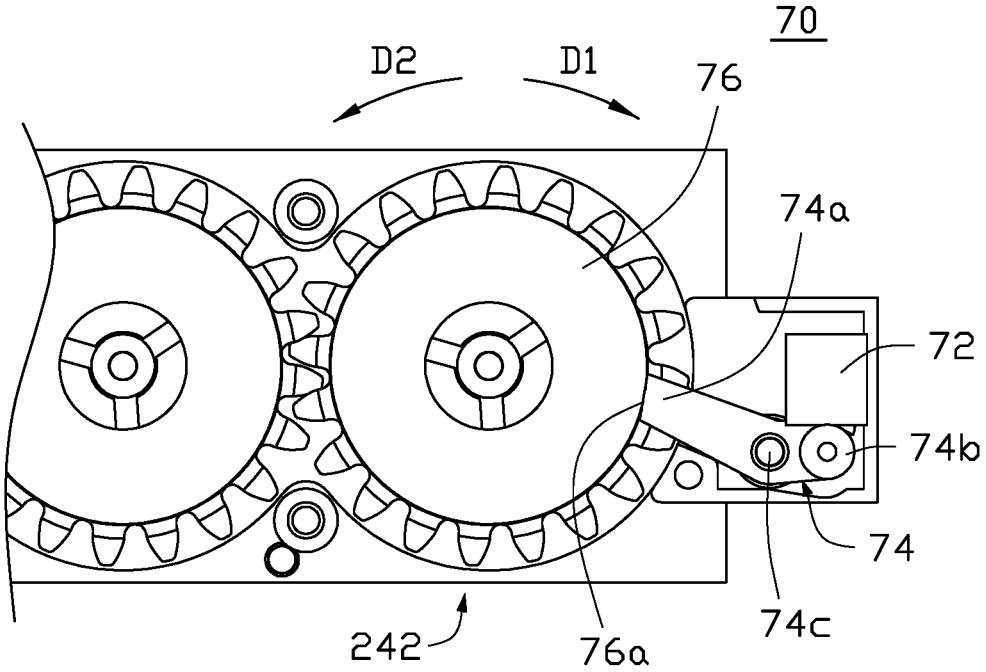
FIG. 23 is a top view of the releasing module in FIG. 22.
Figure 24:
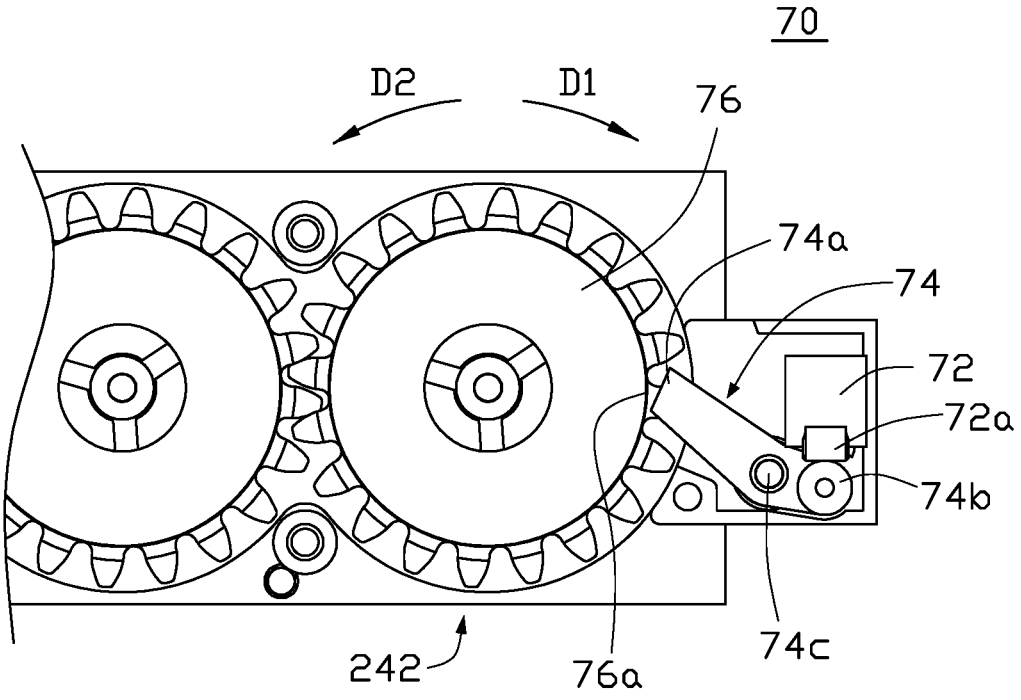
FIG. 24 is an schematic illustration showing operation of the releasing module in FIG. 23.

Referring to FIG. 22 to FIG. 24, a releasing module 70 of a control device 200E of the window covering system 100 is provided. Specifically, FIG. 22 is a perspective view of the releasing module 70 of the control device 200E of the window covering system 100 according to one embodiment of the present disclosure; FIG. 23 is a top view of the releasing module 70 in FIG. 22; FIG. 24 is an schematic illustration showing operation of the releasing module 70 in FIG. 23.

In one embodiment of the present disclosure, the releasing module 70 of the control device 200E comprises a pushing unit 72, a passive unit 74, and a correlating unit 76. The pushing unit 72 is sleeved to the rod 302 and configured to operate simultaneously with the operation module (not denoted). The passive unit 74 is pivotally connected on the shell 102 to correspond to the correlating unit 76. The pushing unit 72 has a protrusion 72*a* corresponding to the passive unit 74 such that the protrusion 72*a* can control the passive unit 74 to engage with or disengage from the correlating unit 76. The passive unit 74 comprises a stopping part 74*a*, a pillar 74*b*, and an axis part 74*c*, wherein the stopping part 74*a* can move with the pillar 74*b* simultaneously. The correlating unit 76 is restricted from rotating in the first direction D1 by the stopping part 74*a* when the stopping part 74*a* of the passive unit 74 is engaged to the correlating unit 76. On the contrary, the correlating unit 76 can rotate in the first direction D1 when the protrusion 72*a* drives the stopping part 74*a* of the passive unit 74 to disengage from the correlating unit 76. In one embodiment of the present disclosure, the pushing unit 72 can be a cam wheel.

In one embodiment of the present disclosure, the stopping part 74*a* of the passive unit 74 is exemplified by a friction block; the correlating unit 76 is exemplified by a friction wheel; the fitting part 76*a* of the correlating unit 76 is exemplified by a friction surface of the friction wheel. The passive part 74 is pivotally connected to the shell 102 about the axis part 74*c*, such that the stopping part 74*a* is corresponding to the fitting part 76*a* of the correlating unit 76, and the protrusion 72*a* of the pushing unit 72 is corresponding to the pillar 74*b* of the passive unit 74.

The protrusion 72*a* is provided at an outer surface of the pushing unit 72 such that protruding outward in a radial direction of the pushing unit 72. In other words, the protrusion 72*a* protrudes in a direction away from an axis of the rod 302. The stopping part 74*a* of the passive unit 74 is urged by a biasing force of an elastic unit (not denoted) to engage to the correlating unit 76, wherein the passive unit 74 can pivot back and forth relative to the correlating unit 76 due to the biasing force of the elastic unit. As shown in FIG. 23, when the stopping part 74*a* is pressed against the correlating unit 76, the correlating unit 76 is restricted from rotating in the first direction D1. As the correlating unit 76 is configured to operate simultaneously and to be coaxial with the winding spool 242, the winding spool 242 cannot rotate in the first direction D1 to release the lifting cord 1063, therefore the weight member 104 and the covering material 106 are stationary.

On the contrary, as shown in FIG. 24, the passive unit 74 is pivoted to cause the stopping part 74*a* moving away from the fitting part 76*a* when the protrusion 72*a* of the pushing unit 72 is driven by the rotation of the rod 302 to push the pillar 74*b*. By this time, the correlating unit 76 and the winding spool 242 can rotate freely, hence the weight member 104 can descend by gravity to expand the covering material 106.

Figure 25:
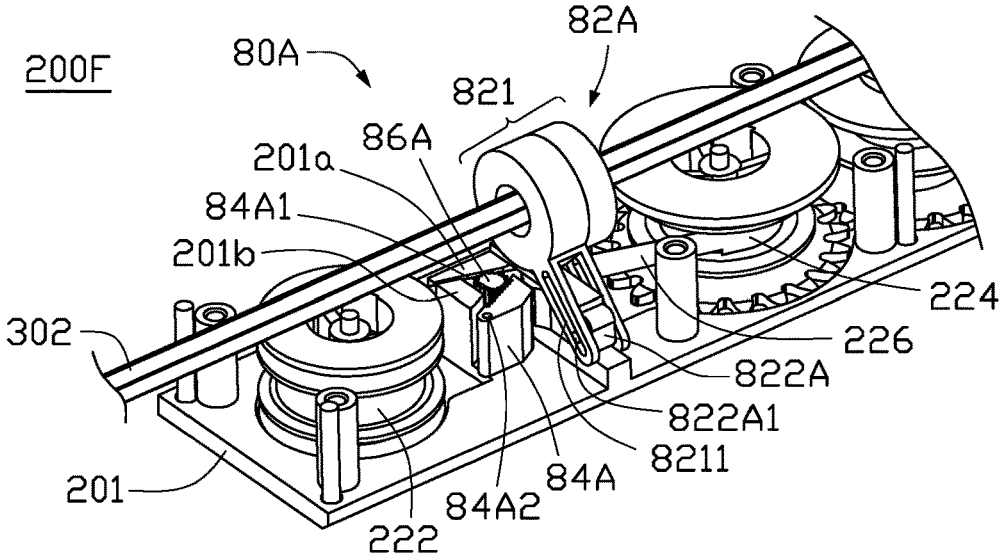
FIG. 25 is a perspective view of a releasing module of the control device of the window covering system in FIG. 1 according to another embodiment of the present disclosure.
Figure 26:
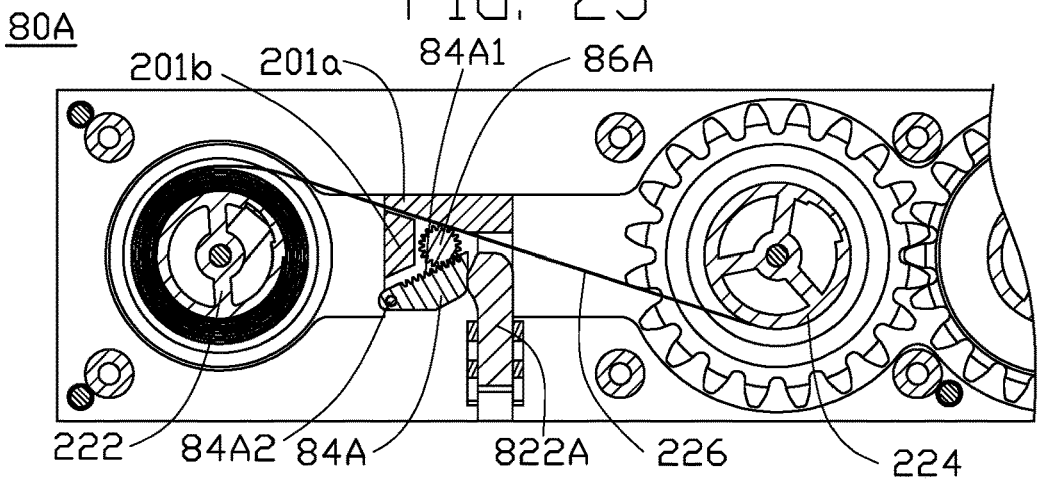
FIG. 26 is a cross-sectional view showing the releasing module in a locking state in FIG. 25.
Figure 27:
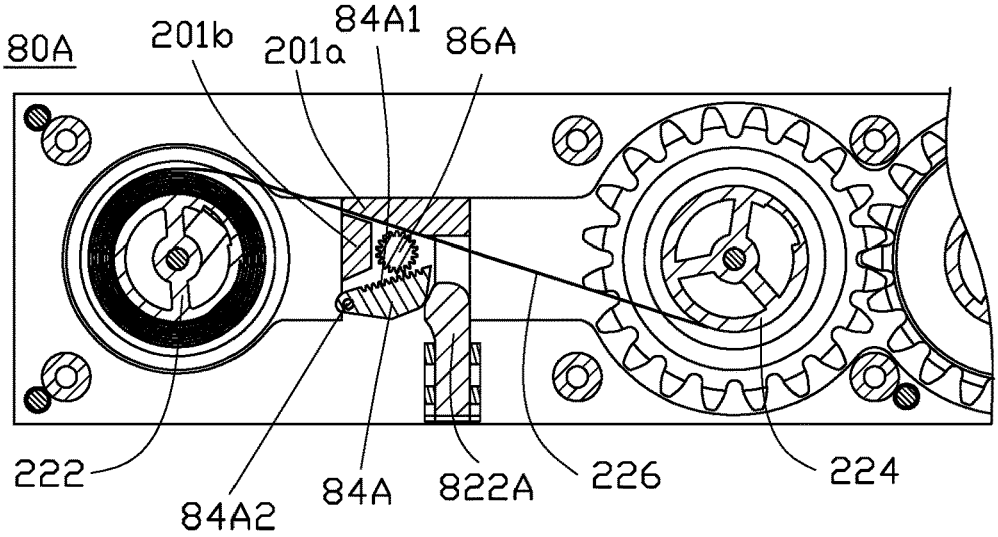
FIG. 27 is a cross-sectional view showing the releasing module in an unlocking state in FIG. 25.
Figure 28:
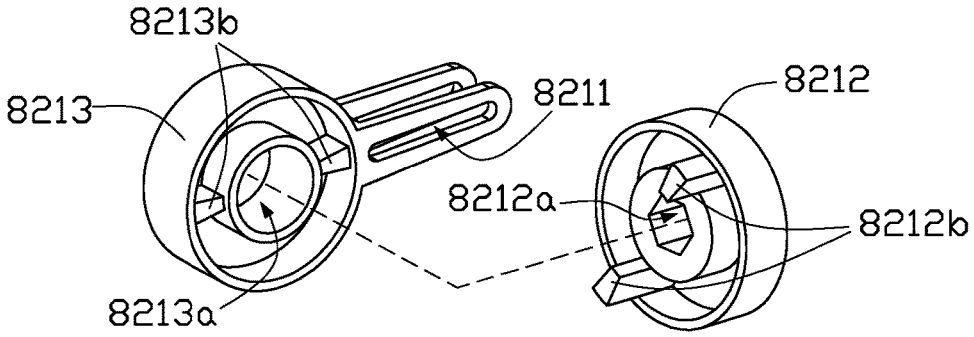
FIG. 28 is an exploded view of a delaying assembly of the releasing module in FIG. 25.

Referring to FIG. 25 to FIG. 28, a releasing module 80A of a control device 200F of the window covering system 100 is provided. Specifically, FIG. 25 is a perspective view showing the releasing module 80A of the control device 200F in a locking state according to one embodiment of the present disclosure; FIG. 26 is a cross-sectional view of the releasing module 80A in FIG. 25; FIG. 27 is a cross-sectional view 25 showing the releasing module 80A in an unlocking state; FIG. 28 is an exploded view of a delaying assembly 821 of the releasing module 80A in FIG. 25 to FIG. 27.

In one embodiment of the present disclosure, the releasing module 80A of the control device 200F comprises a pushing unit 82A, a passive unit 84A, and a correlating unit 86A. The pushing unit 82A is sleeved to the rod 302 and configured to operate with the operation module 110 simultaneously. The passive unit 84A is pivotally connected to the base 201 through an axis part 84A2 and corresponding to the correlating unit 86A. The pushing unit 82A comprises the delaying assembly 821 and a sliding block 822A, wherein the delaying assembly 821 is sleeved to the rod 302, and the sliding block 822A is slidably connected to the delaying assembly 821. More specifically, the delaying assembly 821 comprises two symmetrical channels 8211, and the sliding block 822A comprises two symmetrical protrusions 822A1. Each of the two protrusions 822A1 is positioned within the channel 8211 and configured to slide therein. When the rod 302 rotates, the delaying assembly 821 pivots about the rod 302 and drives the sliding block 822A to slide via the channels 8211 of the delaying assembly 821.

In FIG. 25 and FIG. 26, the pushing unit 82A is configured to push the passive unit 84A, thus the passive unit 84A can press against the resilient member 226 of the power assembly 22 with the correlating unit 86A in between, such that the resilient member 226 is restricted from winding toward the driving wheel 224 from the storing wheel 222. In one embodiment of the present disclosure, the resilient member 226 can be a spiral spring. Alternatively, the resilient member 226 can also be the correlating unit 86A, such that the passive unit 84A can press against the resilient member 226 of the power assembly 22 directly for restricting the resilient member 226 from winding toward the driving wheel 224 from the storing wheel 222. In one embodiment of the present disclosure, the passive unit 84A comprises a toothed face 84A1, and the correlating unit 86A is a pillar with radial teeth, thus the toothed face 84A1 and the correlating unit 86A can engage to each other by toothed engagement. When the pushing unit 82A pushes the passive unit 84A, the passive unit 84A, a block 201*a* of the base 201, and a block 201*b* of the base 201 form a wedge-shaped space (not denoted). The wedge-shaped space comprises a restricting end and a free end. More specifically, when the pushing unit 82A pushes the passive unit 84A to form the wedge-shaped space, if the weight member 104 is about to descend, the power assembly 22 is driven by the winding spool assembly 24, such that the resilient member 226 winds toward the driving wheel 224 from the storing wheel 222. Thus, the resilient member 226 drives the correlating unit 86A toward the restricting end of the wedge-shaped space, so the resilient member 226 is clamped between the correlating unit 86A and the block 201*a*. Therefore, the resilient member 226 is restricted from winding toward the driving wheel 224 from the storing wheel 222, hence the winding spool 242 is restricted from releasing the lifting cord 1063 due to simultaneous operation between the winding spool 242 and the driving wheel 224, such that the weight member 104 and the covering material 106 are stationary. On the contrary, when the weight member 104 is pushed to ascend, the resilient member 226 winds toward the storing wheel 222 from the driving wheel 224 to drive the winding spool assembly 24 to wind the lifting cord 1063. At the same time, the resilient member 226 drives the correlating unit 86A toward the free end of the wedge-shaped space, such that the resilient member 226 is not clamped by the correlating unit 86A and the block 201*a*, therefore the resilient member 226 can wind toward the storing wheel 222 from the driving wheel 224.

As shown in FIG. 27, when the rod 302 rotates, the delaying assembly 821 of the pushing unit 82A pivots about the rod 302, such that the sliding block 822A is moved by the channel 8211 of the delaying assembly 821, so the sliding block 822A does not push the passive unit 84A. Therefore, the resilient member 226 is not clamped by the correlating unit 86A and the block 201*a* even when the correlating unit 86A is moved to the restricting end of the wedge-shaped space by the resilient member 226, such that the resilient member 226 can be driven to wind toward the driving wheel 224 from the storing wheel 222 by the weight member 104 and the winding spool assembly 24.

As shown in FIG. 28, the delaying assembly 821 of the pushing unit 82A comprises a driving member 8212 and a driven member 8213, wherein the driving member 8212 and the driven member 8213 are sleeved to the rod 302 and positioned corresponding to each other. The driving member 8212 comprises a polygonal hole 8212*a*, for example a hexagonal hole, wherein the polygonal hole 8212*a* is corresponding to the rod 302, which is exemplified by a polygonal rod, such that the driving member 8212 is driven by the rod 302 to rotate through the polygonal hole 8212*a*. It should be noted that, the driven member 8213 comprises a round hole 8213*a* which the rod 302 can pass through, such that the driven member 8213 does not rotate with the rod 302.

The driving member 8212 comprises at least one pushing pillar 8212*b*, and the driven member 8213 comprises at least one pushed pillar 8213*b*. When the driving member 8212 is rotated by the rod 302, the driving member 8212 pushes the pushed pillar 8213*b* to move by the pushing pillar 8212*b*, such that the driven member 8213 is pivoted as the driving member 8212 rotates. In one embodiment of the present disclosure, the driving member 8212 comprises two pushing pillars 8212*b*, and the driven member 8213 comprises two pushed pillars 8213*b*, such that the driving member 8212 can rotate to cause the pushing pillars 8212*b* to push the pushed pillars 8213*b* in 180 degrees, thus the driven member 8213 pivots to move the sliding block 822A, so the sliding block 822A does not push the passive unit 84A.

Figure 29:
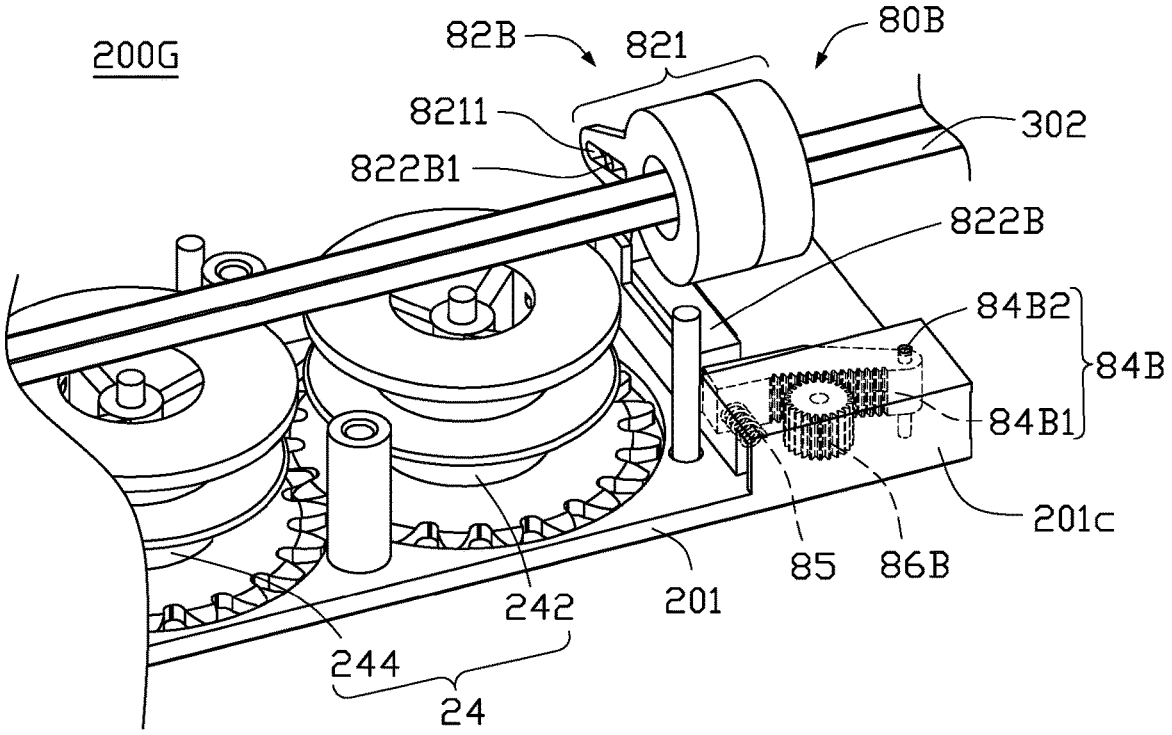
FIG. 29 is a perspective view of a releasing module of the control device of the window covering system in FIG. 1 according to another embodiment of the present disclosure.
Figure 30:
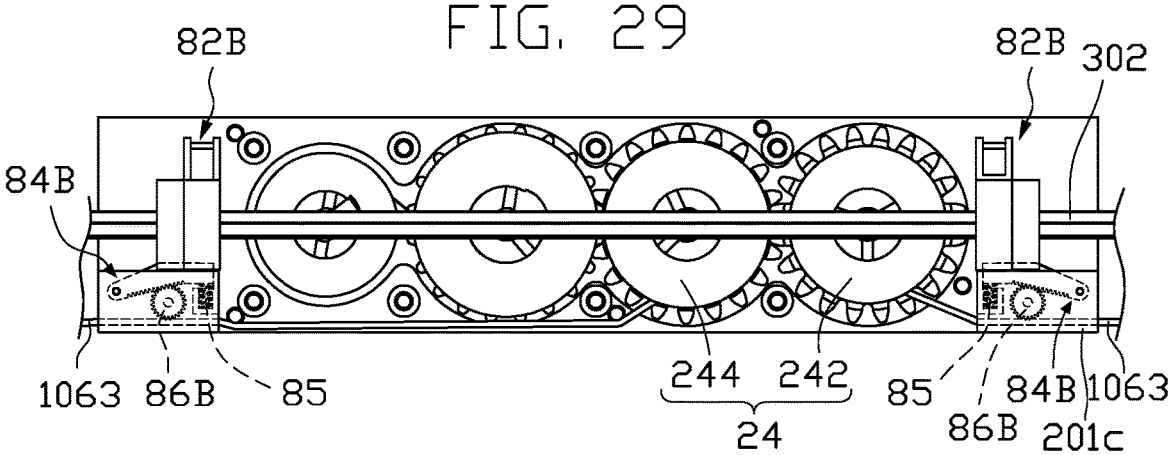
FIG. 30 is a top view showing the releasing module in a locking state in FIG. 29.
Figure 31:
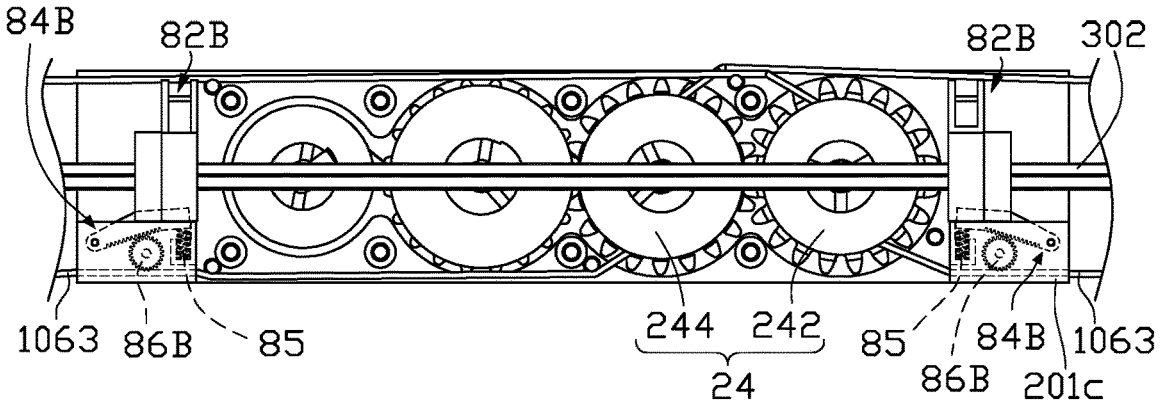
FIG. 31 is a top view showing the releasing module in an unlocking state in FIG. 29.

Referring to FIG. 29 to FIG. 31, a releasing module 80B of a control device 200G of the window covering system 100 is provided. Specifically, FIG. 29 is a perspective view of the releasing module 80B of the control device 200G according to one embodiment of the present disclosure; FIG. 30 is a top view showing the releasing module 80B in a locking state; FIG. 31 is a top view showing the releasing module in an unlocking state in FIG. 29.

In one embodiment of the present disclosure, the releasing module 80B of the control device 200G comprises a pushing unit 82B, a passive unit 84B, and a correlating unit 86B. The pushing unit 82B is sleeved to the rod 302 and configured to operate with the operation module 110 simultaneously. The passive unit 84B is pivotally connected to the base 201 through an axis part 84B2 and corresponding to the correlating unit 86B. The pushing unit 82B comprises the delaying assembly 821 and a sliding block 822B, wherein the delaying assembly 821 is sleeved to the rod 302, and the sliding block 822B is slidably connected to the delaying assembly 821. More specifically, the delaying assembly 821 comprises two symmetrical channels 8211, and the sliding block 822B comprises two symmetrical protrusions 822B1. Each of the two protrusions 822B1 is positioned within the channel 8211 and configured to slide therein. When the rod 302 rotates, the delaying assembly 821 pivots about the rod 302 and drives the sliding block 822B to slide via the channels 8211 of the delaying assembly 821.

As shown in FIG. 30, the pushing unit 82B is configured to push the passive unit 84B, thus the passive unit 84B can press against the lifting cord 1063 with the correlating unit 86B in between, such that the lifting cord 1063 is restricted from being released from the winding spool assembly 24. In other embodiments of the present disclosure, the passive unit 86B can press against the lifting cord 1063 directly for restricting the lifting cord 1063 from being released or wound by the winding spool assembly 24. In one embodiment of the present disclosure, the passive unit 84B comprises a toothed face 84B1, and the correlating unit 86B is a pillar with radial teeth, thus the toothed face 84B1 and the correlating unit 86B can engage to each other by toothed engagement. When the pushing unit 82B pushes the passive unit 84B, the passive unit 84B, a wall 201*c* of the base 201, and an elastic unit 85 form a wedge-shaped space (not denoted). The wedge-shaped space comprises a restricting end and a free end. More specifically, when the pushing unit 82B pushes the passive unit 84B to form the wedge-shaped space, if the weight member 104 is about to descend, the lifting cord 1063 is driven by the weight member 104, such that the lifting cord 1063 is unwound from the winding spool assembly 24. Thus, the lifting cord 1063 drives the correlating unit 86B toward the restricting end of the wedge-shaped space, so the lifting cord 1063 is clamped between the correlating unit 86B and the wall 201*c*. Therefore, the lifting cord 1063 is restricted from being released from the winding spool assembly 24, hence the winding spool 242 is restricted from releasing the lifting cord 1063 due to simultaneous operation between the winding spool 242 and the lifting cord 1063, such that the weight member 104 and the covering material 106 are stationary. On the contrary, when the weight member 104 is pushed to ascend, the resilient member 226 winds toward the storing wheel 222 from the driving wheel 224 to drive the winding spool assembly 24 to wind the lifting cord 1063. At the same time, the lifting cord 1063 drives the correlating unit 86B toward the free end of the wedge-shaped space, such that the lifting cord 1063 is not clamped by the correlating unit 86B and the wall 201*c*, therefore the lifting cord can be wound upon the winding spool assembly 24.

As shown in FIG. 31, when the rod 302 rotates, the delaying assembly 821 of the pushing unit 82B pivots about the rod 302, such that the sliding block 822B is moved by the channel 8211 of the delaying assembly 821, so the sliding block 822B does not push the passive unit 84B, and the passive unit 84B is pushed by the elastic unit 85. Therefore, the lifting cord 1063 is not clamped by the correlating unit 86B and the wall 201*c* even when the correlating unit 86B is moved to the restricting end of the wedge-shaped space by the lifting cord 1063, such that the winding spool assembly can be driven to release the lifting cord 1063 by the weight member 104.

It should be noted that, the delaying assembly 821 of the pushing unit 82B is the same as the delaying assembly 821 of the pushing unit 82A, so the operational mechanism and internal structure of the delaying assembly 821 of the pushing unit 82B can be referred to FIG. 28 and the related illustration, that will not be further illustrated therein.

Figure 32:
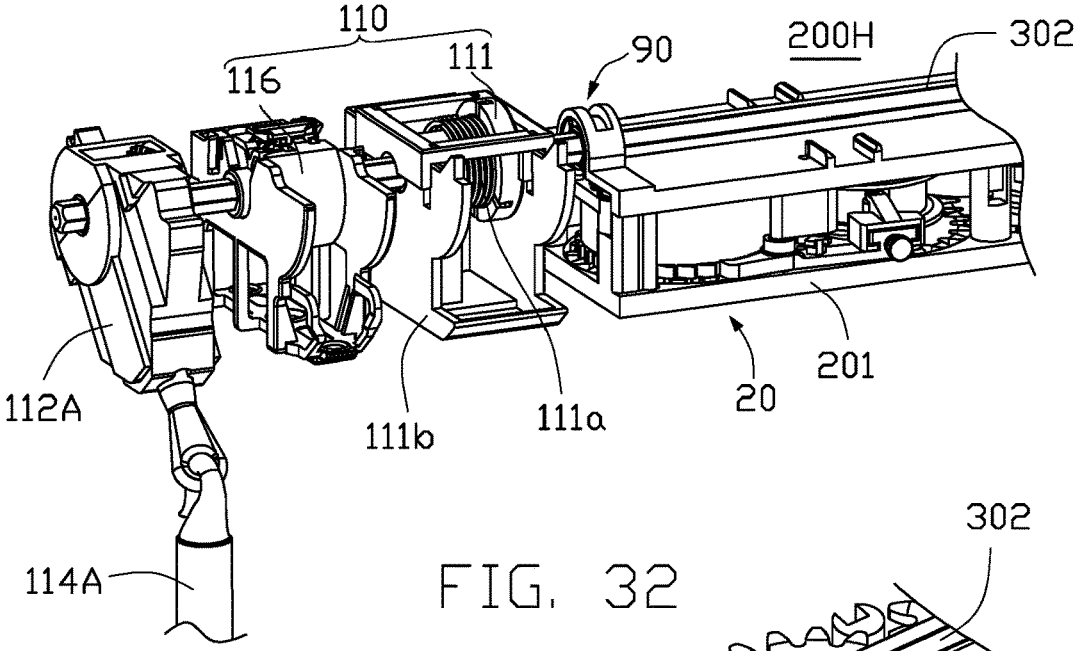
FIG. 32 is a perspective view of a releasing module of the control device of the window covering system in FIG. 1 according to another embodiment of the present disclosure.
Figure 33:
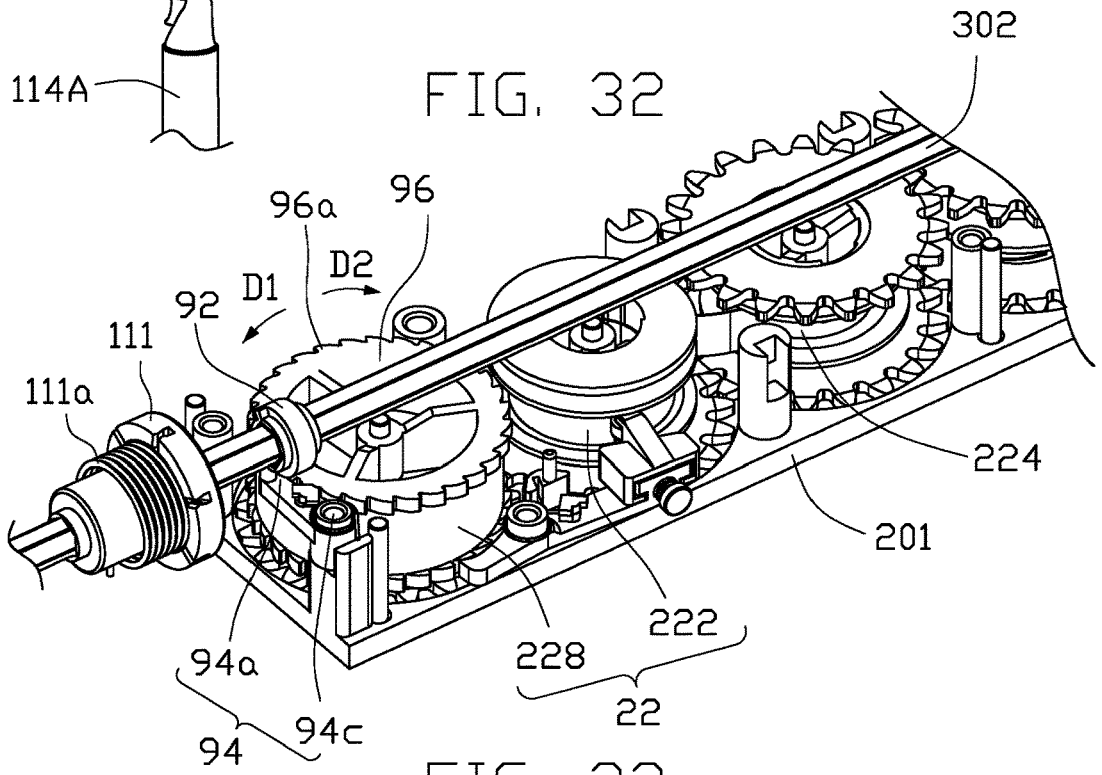
FIG. 33 is another perspective view of the releasing module in FIG. 32.
Figure 34:
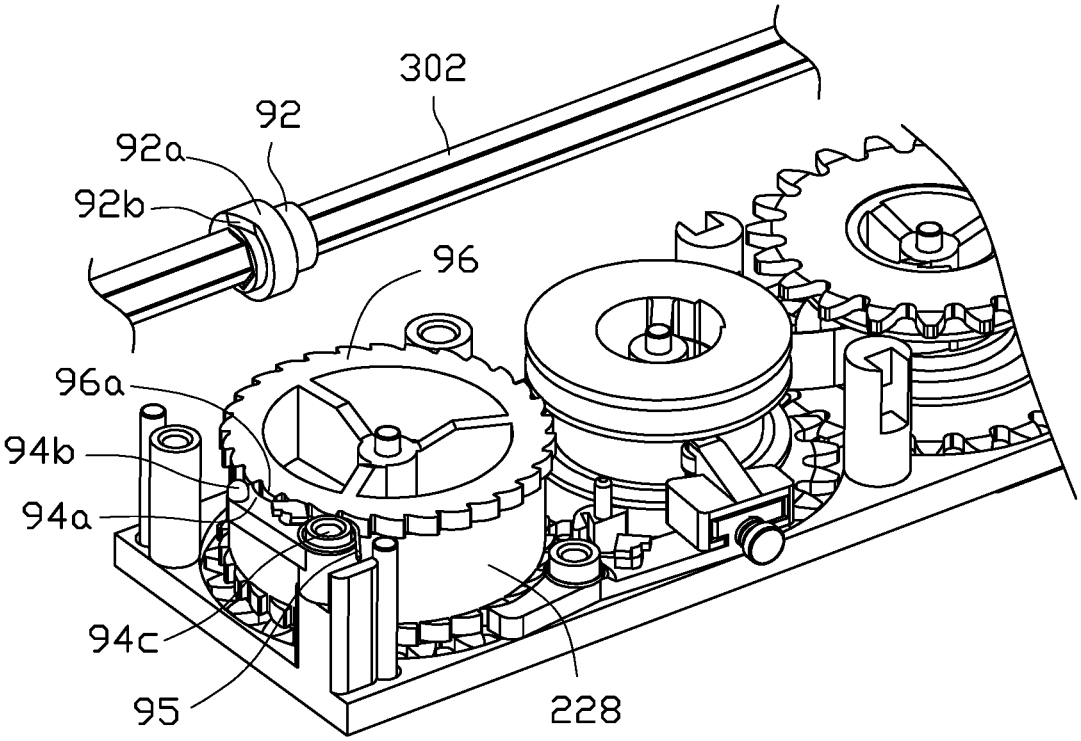
FIG. 34 is a partial exploded view of the releasing module in FIG. 32.
Figure 35:
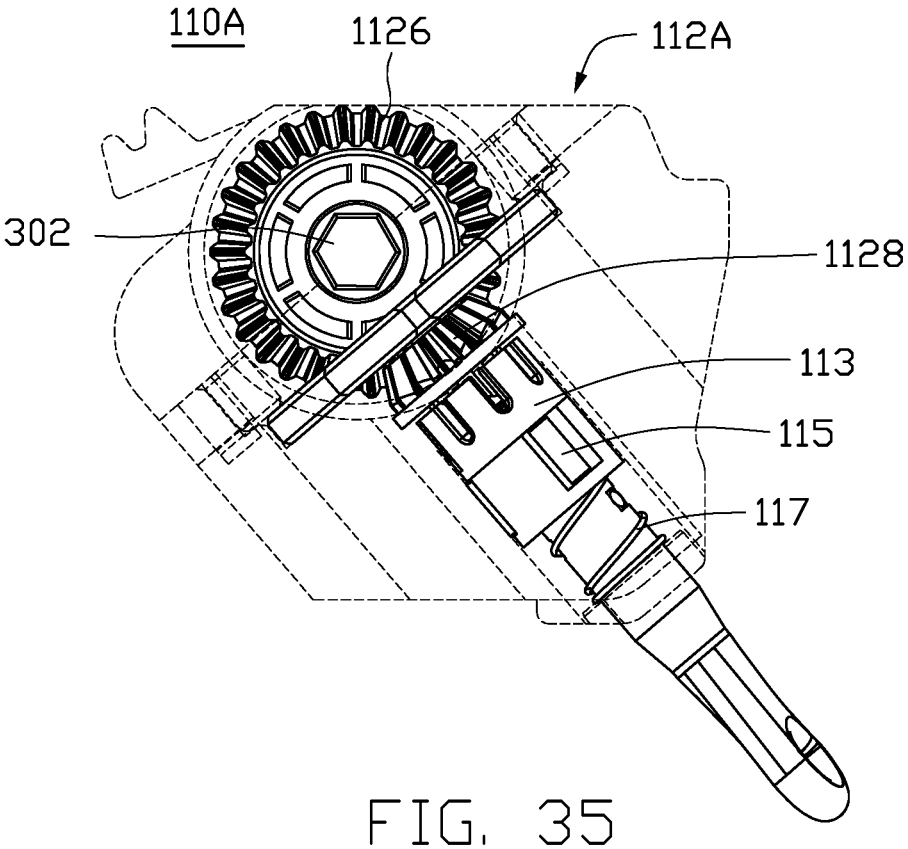
FIG. 35 is a side view of an operation module of the control device in FIG. 32.

Referring to FIG. 32 to FIG. 34, a releasing module 90 of a control device 200H of the window covering system 100 is provided. Specifically, FIG. 32 is a perspective view of the releasing module 90 of the control device 200H of the window covering system 100 according to one embodiment of the present disclosure; FIG. 33 is another perspective view of the releasing module 90 in FIG. 32; FIG. 34 is a partial exploded view of the releasing module 90 in FIG. 32.

In one embodiment of the present disclosure, the releasing module 90 of the control device 200H comprises a pushing unit 92, a passive unit 94, and a correlating unit 96. The pushing unit 92 is sleeved to the rod 302 and configured to operate simultaneously with the operation module 110A. The passive unit 94 is pivotally connected on the base 201 to correspond to the correlating unit 96. The pushing unit 92 has a protrusion 92*a* corresponding to the passive unit 94 such that the protrusion 92*a* can control the passive unit 94 to engage with or disengage from the correlating unit 96. The passive unit 94 comprises a stopping part 94*a*, a pillar 94*b*, and an axis part 94*c*, wherein the stopping part 94*a* can move with the pillar 94*b* simultaneously. The correlating unit 96 is restricted from rotating in the first direction D1 by the stopping part 94*a* when the stopping part 94*a* of the passive unit 94 is engaged to the correlating unit 96. On the contrary, the correlating unit 96 can rotate in the first direction D1 when the protrusion 92*a* drives the stopping part 94*a* of the passive unit 94 to disengage from the correlating unit 96. In one embodiment of the present disclosure, the pushing unit 92 can be a cam wheel.

In one embodiment of the present disclosure, the stopping part 94*a* of the passive unit 94 is exemplified by a pawl; the correlating unit 96 is exemplified by a ratchet wheel; the fitting part 96*a* of the correlating unit 96 is exemplified by the teeth of the ratchet wheel. The passive part 94 is pivotally connected to the base 201 about the axis part 94*c* of the passive part 94, such that the stopping part 94*a* is corresponding to the fitting part 96*a* of the correlating unit 96, and the protrusion 92*a* of the pushing unit 92 is corresponding to the pillar 94*b* of the passive unit 94.

The protrusion 92*a* is provided at an outer surface of the pushing unit 92 such that protruding outward in a radial direction of the pushing unit 92. In other words, the protrusion 92*a* protrudes in a direction away from an axis of the rod 302. The protrusion 92*a* comprises an inclined face 92*b* which can push the pillar 94*b*, thus the pillar 94*b* moves along an axial direction of the rod 302 to drive the passive unit 94 pivoting. The stopping part 94*a* of the passive unit 94 is urged by a biasing force of an elastic unit 95 to engage to the correlating unit 96, wherein the passive unit 94 can pivot back and forth relative to the correlating unit 96 due to the biasing force of the elastic unit 95. When the stopping part 94*a* is engaged to the correlating unit 96, the correlating unit 96 is restricted from rotating in the first direction D1. The correlating unit 96 is configured to operate simultaneously and to be coaxial with a damping module 228, wherein the damping module 228 is positioned adjacent to the storing wheel 222 and the driving wheel 224 of the power assembly 22, such that is configured to operate with the storing wheel 222 and the driving wheel 224 simultaneously. Therefore, the driving wheel 224 cannot rotate in the first direction D1, and the winding spool 242, which is configured to operate with the driving wheel 224 simultaneously, cannot release the lifting cord 1063, therefore the weight member 104 and the covering material 106 are stationary.

On the contrary, the passive unit 94 is pivoted to cause the stopping part 94 disengaging from the fitting part 96*a* when the protrusion 92*a* of the pushing unit 92 is driven by the rotation of the rod 302 to push the pillar 94*b*. By this time, the correlating unit 96, the damping module 228, the driving wheel 224, and the winding spool 242 can rotate freely, hence the weight member 104 can descend by gravity to expand the covering material 106.

Figure 36:
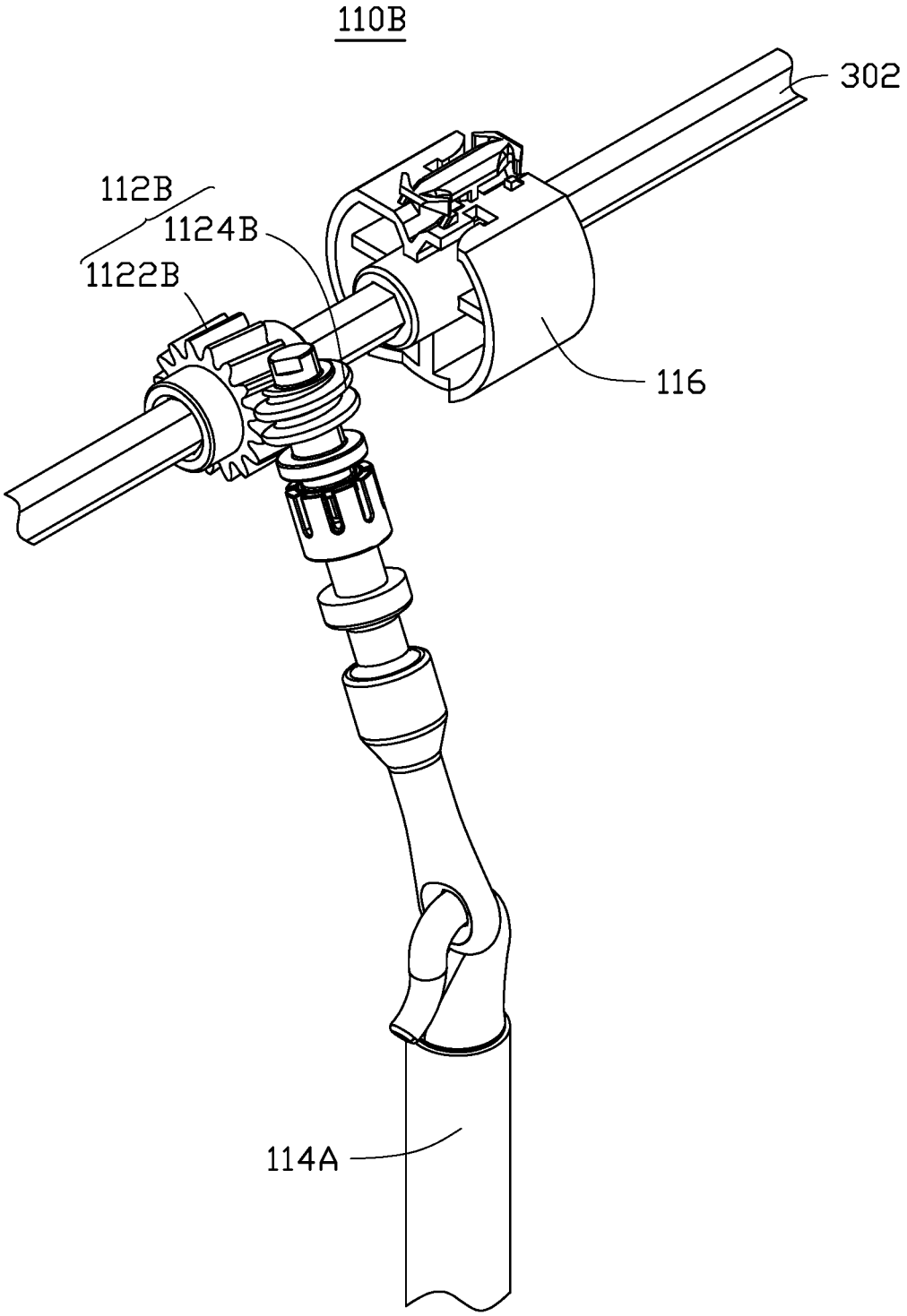
FIG. 36 is a perspective view of an operation module of the control device of the window covering system according to one embodiment of the present disclosure.

It should be noted that, in FIG. 32 and FIG. 36, an operating member 114A is shown as a stick, and an operation module 110A further comprises a power wheel 111, a connecting unit 113, and a two-way clutch 115. The power wheel 111, a tilting assembly 112A, and the tilting wheel 116 are sleeved to the rod 302, wherein the power wheel 111 is positioned on a wheel base 111*b*, such that the tilting assembly 112A can drive the tilting wheel 116 and the power wheel 111 to rotate by the rod 302.

The tilting assembly 112A is configured to drive the rod 302 for rotating the power wheel 111, such that a recovery force is generated by an elastic unit 111*a* which is on the power wheel 111, and the power wheel 111 drives the releasing module 90 to operate by the recovery force of the elastic unit 111*a*. When the power wheel does not have the recovery force of the elastic unit 11*a*, the passive unit 94 of the releasing module 90 is disengaged from the damping module 228, as well as the restriction on the winding spool (not shown) is removed.

The connecting unit 113 and the two-way clutch 115 are positioned between the tilting assembly 112A and the operating 114A. The tilting assembly 112A comprises a bevel gear 1126 and a bevel gear 1128 that are engaged to each other by toothed engagement, wherein the bevel gear 1126 is sleeved to the rod 302 such that the bevel gear 1126 can rotate with the rod 302 simultaneously. The bevel gear 1128 is connected to one end of the connecting unit 113, and the other end of the connecting unit 113 is connected to the two-way clutch 115, such that the connecting unit 113 can control the rotation of the tilting assembly 112A via the two-way clutch 115. An elastic unit 117 is provided to sleeve to the two-way clutch 115, wherein the elasticity of the elastic unit 117 can maintain the engagement between the two-way clutch 115 and the connecting unit 113. It should be noted that, the connecting unit 113 can only be disengaged from the two-way clutch 115 by a pulling force from the operating member 114A. When the connecting unit 113 is disengaged from the two-way clutch 115, the rod 302 is driven to rotate by the recovery force from the elastic unit 111*a* of the power wheel 111, thus driving the releasing module 90 to unlock the power assembly 22. At the same time, the correlating unit 96, the damping module 228, the driving wheel 224, and the winding spool 242 can rotate freely, hence the weight member 104 can descend by gravity to expand the covering material 106.

On the other hand, when the two-way clutch 115 is engaged to the connecting unit 113, the two-way clutch 115 restricts the recovery force of the power wheel 111 from driving the rod 302. In other words, the power wheel 111 cannot drive the rod 302 to rotate, thus the stopping part 94*a* continue engaging with the correlating unit 96, such that restricting the correlating unit 96 from rotating in the first direction D1, as well as restricting the rotation of the driving wheel 224 and the releasing of the lifting cord 1063 by the winding spool 242, hence the weight member 104 and the covering material 106 are stationary.

Figure 37:
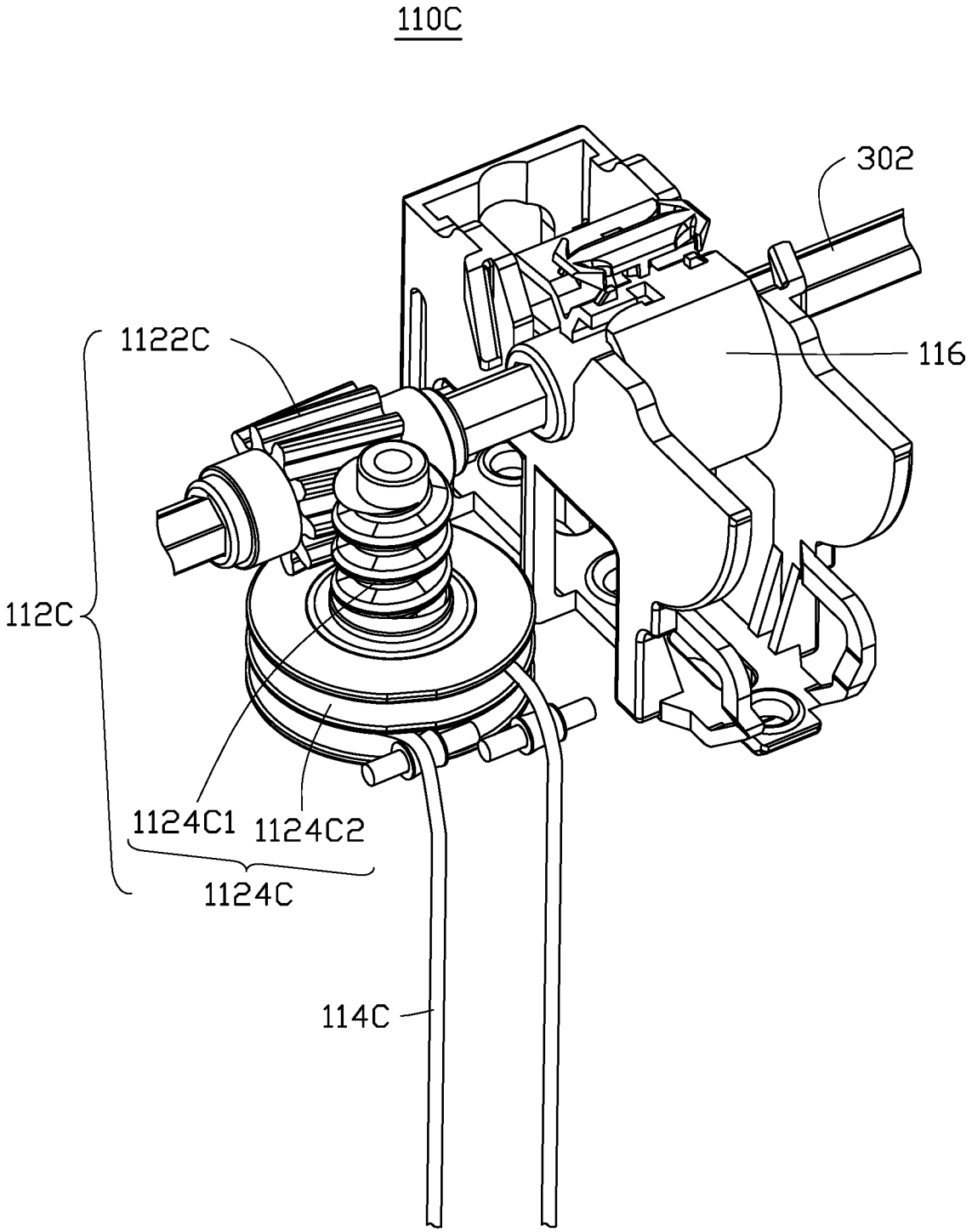
FIG. 37 a perspective view of an operation module of the control device of the window covering system according to another embodiment of the present disclosure.

Furthermore, the operation module 110 of the window covering system 100 in FIG. 1 can operate with any aforementioned releasing module simultaneously through the rod 302 according to any embodiment of the present disclosure regarding the window covering system 100, thus a user can operate to expand the covering material 106 under any condition with ease. Referring to FIG. 36 and FIG. 37, the releasing module of the control device of the window covering system 100 operating with an operation module 110B or 110C is provided. Specifically, FIG. 36 is a perspective view of the operation module 110B of the control device of the window covering system according to one embodiment of the present disclosure; FIG. 37 a perspective view of the operation module 110C of the control device of the window covering system according to another embodiment of the present disclosure.

In FIG. 36, the operation module 110B comprises a tilting assembly 112B, the operating member 114A, and the tilting wheel 116, wherein the tilting assembly 112B and the tilting wheel 116 are sleeved to the rod 302, so the tilting assembly 112B can drive the tilting wheel 116 rotating through the rod 302. The tilting assembly 112B comprises a worm wheel 1122B and a worm gear 1124B that are engaged to each other by toothed engagement, wherein the worm wheel 1122B is sleeved to the rod 302 for rotating with the rod 302 simultaneously, and the worm gear 1124B is connected to the operating member 114A such that the worm gear 1124B is hung in front of the covering material 106 (as shown in FIG. 1 and FIG. 2) for a user to operate, wherein the operating member 114A is exemplified by a stick.

The ladder 1065 comprises two warps (not denoted) and a plurality of wefts (not denoted) connecting between the two warps such that forming the plurality of slots. The plurality of slats 1061 are individually positioned within the plurality of slots of the ladder 1065. In other words, the plurality of slats 1061 are disposed on the plurality of wefts. One end of the ladder 1065 is extended to the shell 102 for connecting with the tilting wheel 116 of the tilting assembly 112B (as shown in FIG. 2), and the other end of the ladder 1065 is connected to the weight member 104. By rotating the operating member 114, which is connected to the worm gear 1124B, the worm gear 1124B is driven to rotate, thus driving the worm wheel 1122B to rotate and as well as the rod 302. Therefore, the tilting wheel 116 sleeved to the rod 302 rotates with the rod 302, such that dislocating the two warps of the ladder 1065 connected to the tilting wheel 116. The dislocation of the two warps can change the angle of the slats 1061 for adjusting the level of light blockage of the covering material 106.

The aforementioned operating member 114A of the operation module 110 is shown as a stick to be operated. However, the operating member can also be exemplified by an adjusting cord, which is shown by the operation module 110C in FIG. 37. The operation module 110C comprises a tilting assembly 112C, an operating member 114C, and the tilting wheel 116, wherein the tilting assembly 112C and the tilting wheel 116 are sleeved to the rod 302, so the tilting assembly 112C can drive the tilting wheel 116 rotating through the rod 302. The tilting assembly 112C comprises a worm wheel 1122C and a worm gear assembly 1124C, wherein the worm wheel 1122C is sleeved to the rod 302, and the worm gear assembly 1124C comprises a worm gear 1124C1 and a dividing plate 1124C2, wherein the worm gear 1124C1 and the worm wheel 1122C are engaged to each other by toothed engagement. The operating member 114C is exemplified by the adjusting cord, wherein the operating member 114C is positioned around the dividing plate 1124C2 such that both ends of the operating member 114C are free ends and hung in front of the covering material 106 to be operated. One end of the ladder 1065 is connected to the tilting wheel 116, and the other end is connected to the weight member 104. By pulling one free end of the operating member 114C, which is exemplified by the adjusting cord, the worm gear 1124C1 is rotated to drive the worm wheel 1122C rotating, thus the rod 302 is rotated to drive the tilting wheel 116 rotating, and hence the angle of the slats 1061 is adjusted for controlling the level of light blockage.

In one embodiment of the present disclosure, the rod 302 can connect to any aforementioned tilting assembly and any aforementioned pushing unit of any releasing module, thus the tilting assembly can operate with the releasing module simultaneously. When the slats 1061 are rotated by the tilting assembly to a predetermined angle, the rod 302 can drive the pushing unit to push the passive unit, such that the passive unit disengages from the correlating unit. At the same time, the winding assembly is driven by the weight member 104 via the lifting cord 1063 to operate in the first direction D1, and the correlating unit operates with the winding assembly.

As shown in various foregoing embodiments regarding the control device, the releasing module is employed as a switch mechanism, which functions by the one-way locking of the passive unit, wherein the releasing module can be operated by a user to ascend the weight member and to stop the weight member at any desire position. On the other hand, the releasing module can also be operated to unlock the winding spool, which is locked by the passive unit directly or indirectly, for allowing the weight member to descend by gravity hence expanding the covering material. Furthermore, the operation module can be a power source of driving the rod, thus the operating member of the operation module can be used to drive the releasing module to operate. Therefore, the inconvenience of different weight member operable height of different user is eased, thus the weight member can be descended easily to expand the covering material.

It will be apparent to those skilled in the art that the present disclosure is not limited to the details of the foregoing exemplary embodiments, and that the disclosure may be realized in any other specific forms without departing from the spirit or essential characteristics of the present disclosure. Therefore, all the aforementioned embodiments should only be considered as illustrative and not restrictive in all aspects. The scope of the disclosure is defined by the claims rather than by the foregoing descriptions, and therefore the scope of the disclosure is intended to cover any changes within equivalent meaning and range thereof.

What is claimed is:

1. A window covering system, comprising:

a shell positioned horizontally;

a weight member positioned below the shell;

a covering material positioned between the shell and the weight member, wherein the covering material comprises:

at least one ladder, wherein the ladder comprises two warps, and one end of each warp is extended to the shell, and the other end of each warp is connected to the weight member;

a plurality of slats, each of which is spaced and parallel to the other between the two warps; and at least one lifting cord, wherein one end of the lifting cord is extended to the shell, and the other end of the lifting cord is connected to the weight member with the plurality of the slats between the shell and the weight member;

a control device comprising:

a driving module positioned within the shell, wherein the driving module comprises a winding assembly, the end of the lifting cord extended to the shell is connected and wound upon the winding assembly, such that the winding assembly is configured to wind or release the lifting cord for moving the weight member toward or away from the shell, and wherein the weight member is configured to drive the winding assembly operating in a first direction via the lifting cord when the weight member moves away from the shell;

a releasing module positioned within the shell and configured to operate with the winding assembly simultaneously, wherein the releasing module comprises a pushing unit, a passive unit, and a correlating unit, and wherein the passive unit is positioned corresponding to the pushing unit, and the correlating unit is connected to the driving module such that the correlating unit is configured to operate with the winding assembly simultaneously, and wherein the passive unit is configured to detachably engage the correlating unit such that the winding assembly is restricted from operating in the first direction when the passive unit is engaged to the correlating unit; and an operation module positioned within the shell and configured to operate with the releasing module simultaneously, wherein the operation module comprises a rod and a tilting assembly, and wherein the end of at least one of the two warps extended to the shell is connected to the tilting assembly, such that the tilting assembly is configured to dislocate the two warps for changing an angle of the slats, and wherein the rod is connected between the tilting assembly and the pushing unit of the releasing module, such that when the slats are rotated to a predetermined angle by the tilting assembly, the rod is configured to rotate the pushing unit pushing the passive unit to disengage the passive unit from the correlating unit, thereby the winding assembly is driven by the weight member via the lifting cord to operate in the first direction, such that the correlating unit and the winding assembly operate simultaneously.

2. The window covering system according to claim 1, wherein the operation module further comprises an operating member connected to the tilting assembly, wherein the operating member is configured to drive the tilting assembly to control the rotation of the rod for driving the lifting cord in order to change the angle of the slats, thereby adjusting a level of light blockage of the covering material.

3. The window covering system according to claim 1, wherein the pushing unit is sleeved to the rod, wherein the pushing unit comprises a protrusion which is away from an axis of the rod, and wherein the passive unit comprises a pillar positioned corresponding to the protrusion of the pushing unit; when the rod drives the pushing unit to rotate, the protrusion is configured to push the pillar to move, such that the passive unit is disengaged from the correlating unit, thereby the winding assembly is driven to operate in the first direction by the weight member.

4. The window covering system according to claim 3, wherein the passive unit further comprises a stopping part and an axis part, wherein the stopping part is configured to operate with the pillar simultaneously, and wherein the correlating part comprises a fitting part, wherein the stopping part is configured to detachably engage the fitting part, when the rod rotates and the protrusion pushes the pillar, the passive unit is configured to pivot about the axis part.

5. The window covering system according to claim 4, wherein the passive unit further comprises an elastic unit sleeved to the axis part, wherein the elastic unit is configured to urge the stopping part of the passive unit engaging the fitting part of the correlating unit when no external force is applied thereto.

6. The window covering system according to claim 4, wherein the stopping part of the passive unit is a pawl or a friction block, and the correlating unit is a ratchet wheel or a friction wheel, and when the stopping part is the pawl, the pawl is corresponding to the ratchet wheel, such that the pawl is configured to detachably engage between the teeth of the ratchet wheel, and when the stopping part is the friction block, the friction block is corresponding to the friction wheel, such that the friction block is configured to detachably press against the friction wheel.

7. The window covering system according to claim 1, wherein the winding assembly is a winding spool assembly, and the weight member is configured to drive the winding spool assembly by the lifting cord to operate in the first direction while the weight member moving away from the shell.

8. The window covering system according to claim 7, wherein the correlating unit of the releasing module is coaxial to at least one winding spool of the winding spool assembly, wherein the operation module is configured to drive the releasing module such that the pushing unit pushes the passive unit disengaging from the correlating unit, thereby the winding spool is driven by the weight member via the lifting cord to rotate in the first direction, such that the correlating unit and the winding spool operate simultaneously.

9. The window covering system according to claim 1, wherein the driving module further comprises a power assembly; while the weight member is moving toward the shell, the power assembly is configured to drive the winding assembly back to an initial state such that the weight member is closest to the shell; and wherein the power assembly, the winding assembly, and the correlating unit of the releasing module are configured to operate simultaneously.

10. The window covering system according to claim 9, wherein the correlating unit of the releasing module is connected to the power assembly, and wherein the operation module is configured to drive the releasing module to operate; when the passive unit is disengaged from the correlating unit by the pushing unit, the winding assembly is driven by the weight member via the lifting cord to operate in the first direction, such that the correlating unit and the power assembly operate simultaneously.

11. The window covering system according to claim 10, wherein the power assembly comprises a driving wheel, a storing wheel, and a resilient member, wherein one end of the resilient member is wound to the driving wheel, and the other end of the resilient member is wound to the storing wheel, thereby the driving wheel and the storing wheel are configured to operate simultaneously, and wherein the correlating unit of the releasing module is connected to at least one of the driving wheel and the storing wheel; when the passive unit is engaged to the correlating unit, the releasing module is configured to restrict the winding assembly from operating in the first direction; when the operation module drives the releasing module to operate, and the pushing unit pushes the passive unit to disengage from the correlating unit, the winding assembly is driven by the weight member via the lifting cord to operate in the first direction, such that at least one of the driving wheel and the storing wheel operates simultaneously with the correlating unit.

12. The window covering system according to claim 11, wherein the correlating unit is coaxial to at least one of the driving wheel and the storing wheel; when the operation module drives the releasing module to operate, and the pushing unit pushes the passive unit to disengage from the correlating unit, the winding assembly is driven by the weight member via the lifting cord to operate in the first direction, such that at least one of the driving wheel and the storing wheel operates simultaneously with the correlating unit.

13. The window covering system according to claim 1, wherein the correlating unit of the releasing module is a spiral spring, wherein the driving module further comprises a power assembly, wherein the power assembly, the winding assembly and the correlating unit of the releasing module are configured to operate simultaneously, and wherein the power assembly comprises a driving wheel and a storing wheel that are configured to operate simultaneously, and wherein one end of the correlating unit is wound to the driving wheel, and the other end of the correlating unit is wound to the storing wheel, and wherein the passive unit is corresponding to the correlating unit such that the passive unit is configured to detachably engage the correlating unit; when the operation module drives the releasing module to operate, and the pushing unit pushes the passive unit to disengage from the correlating unit, such that the winding assembly is driven by the weight member via the lifting cord to operate in the first direction, thereby the correlating unit winds toward the driving wheel from the storing wheel.

14. The window covering system according to claim 13, wherein the pushing unit comprises a protrusion away from an axis of the rod, and wherein the passive unit comprises a pillar, an axis part, and a stopping part, wherein the pillar is configured to operate with the stopping part simultaneously, and the pillar is positioned corresponding to the protrusion of the pushing unit, and wherein the stopping part is a friction block corresponding to the correlating unit, such that the friction block is configured to detachably press against the correlating unit; when the pushing unit is driven to rotate by the rod, the protrusion pushes the pillar to move such that the passive unit pivots about the axis part, and the friction block is moved away from the correlating unit, thereby the winding assembly is driven by the weight member via the lifting cord to operate in the first direction.

15. The window covering system according to claim 1, wherein the driving module further comprises a power assembly, wherein the power assembly, the winding assembly and the correlating unit of the releasing module are configured to operate simultaneously, and wherein the power assembly comprises a driving wheel, a storing wheel, and a spiral spring, wherein the driving wheel and the storing wheel are configured to operate simultaneously, and wherein one end of the spiral spring is wound to the driving wheel, and the other end of the spiral spring is wound to the storing wheel, and wherein the correlating unit is positioned between the spiral spring and the passive unit, such that the correlating unit is configured to detachably press the spiral spring; when the correlating unit presses against the spiral spring, the operation module drives the releasing module to operate, and the pushing unit moves the passive unit, such that the correlating unit is moved away from the spiral spring, thereby the spiral spring is wound toward the driving wheel from the storing wheel, and the winding assembly is driven by the weight member via the lifting cord to operate in the first direction.

16. The window covering system according to claim 1, wherein the correlating unit is positioned between the lifting cord and the passive unit, wherein the correlating unit is corresponding to the lifting cord, such that the correlating unit is configured to detachably press the lifting cord; when the correlating unit presses the lifting cord, and the operation module drives the releasing module to operate, such that the pushing unit pushes the passive unit to move, and the correlating unit is moved away from the lifting cord, thereby the winding assembly releases the lifting cord, and the winding assembly is driven by the weight member via the lifting cord to operate in the first direction.

17. The window covering system according to claim 1, wherein the winding assembly is a sliding assembly, and the weight member is configured to drive a sliding unit of the sliding assembly by the lifting cord to move in the first direction while the weight member moving away from the shell.

* * * * *